US010082761B2

(12) United States Patent
Narita et al.

(10) Patent No.: US 10,082,761 B2
(45) Date of Patent: Sep. 25, 2018

(54) IMAGE FORMING APPARATUS INCLUDING A ROTATABLE EXPOSURE DEVICE

(71) Applicants: Susumu Narita, Tokyo (JP); Takeshi Yamakawa, Kanagawa (JP); Yoshinobu Sakaue, Kanagawa (JP); Kazunori Watanabe, Tokyo (JP); Tomoya Fujii, Kanagawa (JP); Ryo Sato, Tokyo (JP)

(72) Inventors: Susumu Narita, Tokyo (JP); Takeshi Yamakawa, Kanagawa (JP); Yoshinobu Sakaue, Kanagawa (JP); Kazunori Watanabe, Tokyo (JP); Tomoya Fujii, Kanagawa (JP); Ryo Sato, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/630,059

(22) Filed: Jun. 22, 2017

(65) Prior Publication Data

US 2017/0371292 A1 Dec. 28, 2017

(30) Foreign Application Priority Data

Jun. 22, 2016 (JP) ..... 2016-123835
Jun. 20, 2017 (JP) ..... 2017-120380

(51) Int. Cl.
*G03G 15/04* (2006.01)
*G03G 21/00* (2006.01)

(52) U.S. Cl.
CPC ..... *G03G 21/00* (2013.01); *G03G 15/04* (2013.01); *G03G 2221/0005* (2013.01)

(58) Field of Classification Search
CPC .. G03G 15/04; G03G 15/04036; G03G 21/00; G03G 21/1666; G03G 2221/0005; G03G 2221/1636
See application file for complete search history.

(56) References Cited

U.S. PATENT DOCUMENTS 8,428,489 B2 * 4/2013 Sameshima ..... G03G 21/1676 399/110
2008/0013115 A1 * 1/2008 Nakano ..... G03G 21/1666 358/1.9

(Continued)

FOREIGN PATENT DOCUMENTS

JP 7-314779 12/1995
JP 11-314402 11/1999

(Continued)

OTHER PUBLICATIONS

Machine translation of JP 2001-175046 (publication dated of Jun. 29, 2001) printed on Jan. 23, 2018.*

*Primary Examiner* — Sophia S Chen
(74) *Attorney, Agent, or Firm* — Harness, Dickey & Pierce, P.L.C.

(57) ABSTRACT

An image forming apparatus includes an image bearer, an exposure device, a drive device, a cleaning body, and an exposure device holder. The exposure device is disposed on a motion trajectory between an exposure position and a retracted position and emits light to the image bearer via a lens having a lens surface at the exposure position. The drive device causes the exposure device to move between the exposure position and the retracted position. The cleaning body disposed on the motion trajectory of the exposure device tilts a cleaning surface when contacting with the lens surface of the exposure device. The exposure device holder supports the exposure device while changing an attitude of the exposure device such that the lens surface remains in contact with the cleaning surface of the cleaning body when the exposure device moves from the retracted position to the exposure position.

20 Claims, 35 Drawing Sheets

(56) References Cited

U.S. PATENT DOCUMENTS

| | | | | |
|---|---|---|---|---|
| 2013/0100225 | A1* | 4/2013 | Kodo | G03G 21/1666 347/224 |
| 2013/0259516 | A1* | 10/2013 | Ikeda | G03G 21/1666 399/110 |
| 2013/0308983 | A1 | 11/2013 | Takano | |

FOREIGN PATENT DOCUMENTS

| | | |
|---|---|---|
| JP | 2001-175046 | 6/2001 |
| JP | 2014-002350 | 1/2014 |
| JP | 2014-235355 | 12/2014 |

* cited by examiner

IMAGE FORMING APPARATUS INCLUDING A ROTATABLE EXPOSURE DEVICE

CROSS-REFERENCE TO RELATED APPLICATIONS

This patent application is based on and claims priority pursuant to 35 U.S.C. § 119(a) to Japanese Patent Application Nos. 2016-123835, filed on Jun. 22, 2016, and 2017-120380, filed on Jun. 20, 2017, in the Japan Patent Office, the entire disclosure of each of which is hereby incorporated by reference herein.

BACKGROUND

Technical Field

This disclosure relates to an image forming apparatus.

Related Art

Various types of image forming apparatuses include an exposure device that movably approaches and separates from an image bearer while maintaining an attitude of the exposure device. Such image forming apparatuses are known to include a cleaning member that is changeable in shape and that is disposed such that a cleaning face thereof is vertical relative to a moving direction on a trajectory of the exposure device. In such image forming apparatuses, when the exposure device moves to approach the image bearer while maintaining the attitude thereof, a surface of a lens provided at the leading end of the exposure device in the moving direction contacts the cleaning face of the cleaning member, and therefore the surface of the lens is cleaned.

For example, a known image forming apparatus includes a deformable sheet member (that is, a cleaning pad) disposed at an opening formed in a frame that supports a photoconductor such that the cleaning face of the deformable sheet member is vertically disposed with respect to the moving direction of an LED head (that is, an exposure device). The deformable sheet member (the cleaning pad) is attached to contact the LED head to cause a cleaning face forming portion to incline. By so doing, the surface of the lens of the LED head (the exposure device) passes through the opening of the frame so as to approach the photoconductor. In this known image forming apparatus, when the LED head passes through the opening of the frame and moves to approach the photoconductor while the LED head is maintaining the attitude, the surface of the lens provided at the leading end of the LED head in the moving direction contacts the cleaning face of the cleaning pad of the sheet member, and therefore the surface of the lens is cleaned by the cleaning pad.

In the above-described known image forming apparatus, as the exposure device moves to approach the image bearer, the exposure device starts to contact the cleaning face of the cleaning member, and the lens surface provided at the leading end of the exposure device in the moving direction contacts the cleaning face of the cleaning member. As the exposure device further presses the cleaning member while the exposure device is maintaining the same attitude, the cleaning face forming portion of the cleaning member deforms to tilt the cleaning face that has been vertically maintained to the moving direction of the exposure device. This inclination of the cleaning face causes the cleaning face to gradually separate from the surface of the lens provided at the leading end of the exposure device in the moving direction while the exposure device is holding the attitude, which makes difficult to maintain a good cleaning performance to the surface of the lens of the exposure device.

SUMMARY

At least one aspect of this disclosure provides an image forming apparatus including an image bearer, an exposure device, a drive device, a cleaning body, and an exposure device holder. The exposure device is disposed on a motion trajectory between an exposure position close to the image bearer and a retracted position separated from the image bearer. The exposure device is configured to emit light to the image bearer via a lens having a lens surface at the exposure position at which the image bearer is irradiated. The drive device is configured to cause the exposure device to move between the exposure position and the retracted position. The cleaning body has a flexible shape and is disposed on the motion trajectory of the exposure device. The cleaning body is configured to tilt a cleaning surface when contacting with the lens surface of the exposure device. The exposure device holder is configured to support the exposure device while changing an attitude of the exposure device such that the lens surface of the exposure device remains in contact with the cleaning surface of the cleaning body that inclines by a contact pressure applied by the lens surface of the exposure device when the exposure device moves from the retracted position to the exposure position.

DETAILED DESCRIPTION

Figure 1:
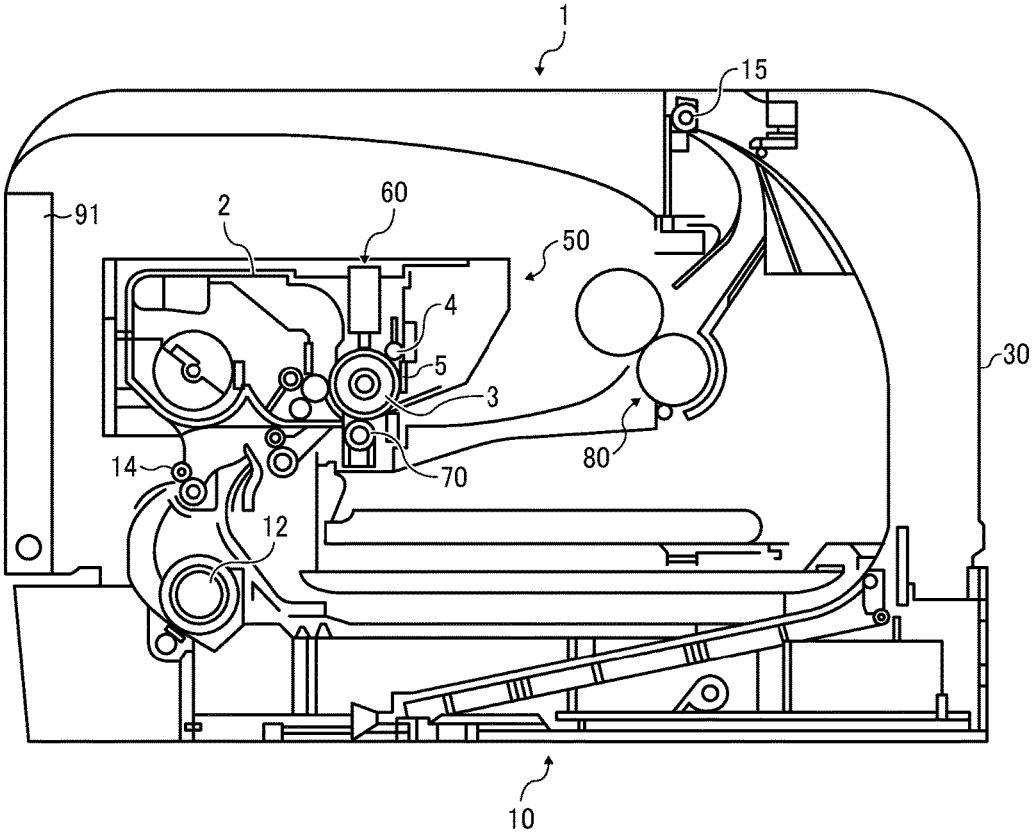
FIG. 1 is a schematic configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

A description is given of a configuration and functions of an image forming apparatus according to an embodiment of this disclosure, with reference to drawings.

It is to be noted that identical parts are given identical reference numerals and redundant descriptions are summarized or omitted accordingly.

Now, a description is given of a laser printer that functions as an image forming apparatus. It is to be noted that, hereinafter, the laser printer is referred to as the image forming apparatus 1.

A description is given of the image forming apparatus 1 according to an embodiment of this disclosure.

FIG. 1 is a schematic configuration of the image forming apparatus 1 according to an embodiment of this disclosure.

It is to be noted that identical parts are given identical reference numerals and redundant descriptions are summarized or omitted accordingly.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is a laser printer that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying passage to a downstream side thereof; the term "width direction" indicates a direction basically perpendicular to the sheet conveying direction.

As illustrated in FIG. 1, the image forming apparatus 1 includes a process cartridge 50, an exposure device 60, a transfer roller 70, a sheet tray 10, and a fixing device 80 in an apparatus body 30 thereof. The transfer unit includes a transfer roller 70. The process cartridge 50 is detachably attachable to the apparatus body 30 of the image forming apparatus 1. The exposure device 60 functions as a latent image forming device.

The process cartridge 50 includes a photoconductor drum 3 that functions as a latent image bearer, a charging roller 4 that functions as a charger, a developing device 2, and a cleaning device 5 that functions as a cleaner.

The photoconductor drum 3 rotates in the counterclockwise direction in FIG. 1.

The charging roller 4 uniformly charges a surface of the photoconductor drum 3 while the photoconductor drum 3 is rotating.

The exposure device 60 that functions as a latent image forming device emits laser light to irradiate the surface of the photoconductor drum 3 so as to form an electrostatic latent image on the surface thereof based on image data of the image.

The developing device 2 develops the electrostatic latent image formed on the photoconductor drum 3 into a visible toner image.

A transfer unit including the transfer roller 70 transfers the toner image formed on the photoconductor drum 3 from the sheet tray 10 onto a sheet that functions as a recording medium. The sheet is fed from the sheet tray 10 by a sheet feed roller 12 and conveyed by a pair of registration rollers 14.

After the toner image has been transferred onto the sheet, the fixing device 80 fixes the toner image to the sheet. The sheet is discharged by a sheet ejection roller 15 to an outside of the image forming apparatus 1.

The cleaning device 5 removes residual toner remaining on the surface of the photoconductor drum 3 from the surface of the photoconductor drum 3. Further, an electrical discharge lamp that functions as an electrical discharger removes residual electrical charge from the surface of the photoconductor drum 3.

In a case in which the process cartridge 50 is replaced due to mechanical aging changes of the photoconductor drum 3 and the developing device 2, a user opens a cover 91 provided on a left side face of the apparatus body 30 illustrated in FIG. 1 and removes the process cartridge 50 from the left side face of the apparatus body 30. By opening the cover 91, the process cartridge 50 can be removed from a left side face in the drawing of the image forming apparatus 1.

It is to be noted that the process cartridge 50 according to the present embodiment integrally supports the photoconductor drum 3 and the developing device 2 as a single unit. However, the photoconductor drum 3 and the developing device 2 may be provided separately and detachably attachable to the apparatus body 30.

Figure 2B:
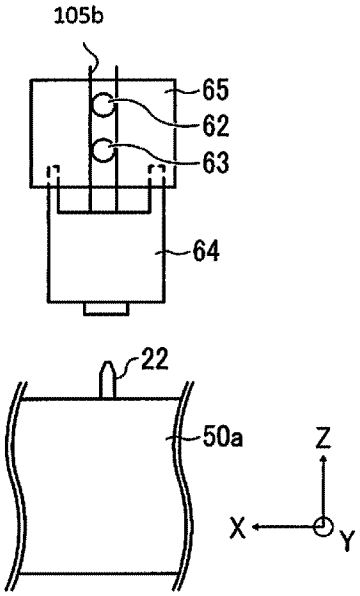
FIG. 2B is a side view illustrating the schematic configuration of the exposure device and the adjacent components incorporated in the image forming apparatus of FIG. 1.
Figure 2A:
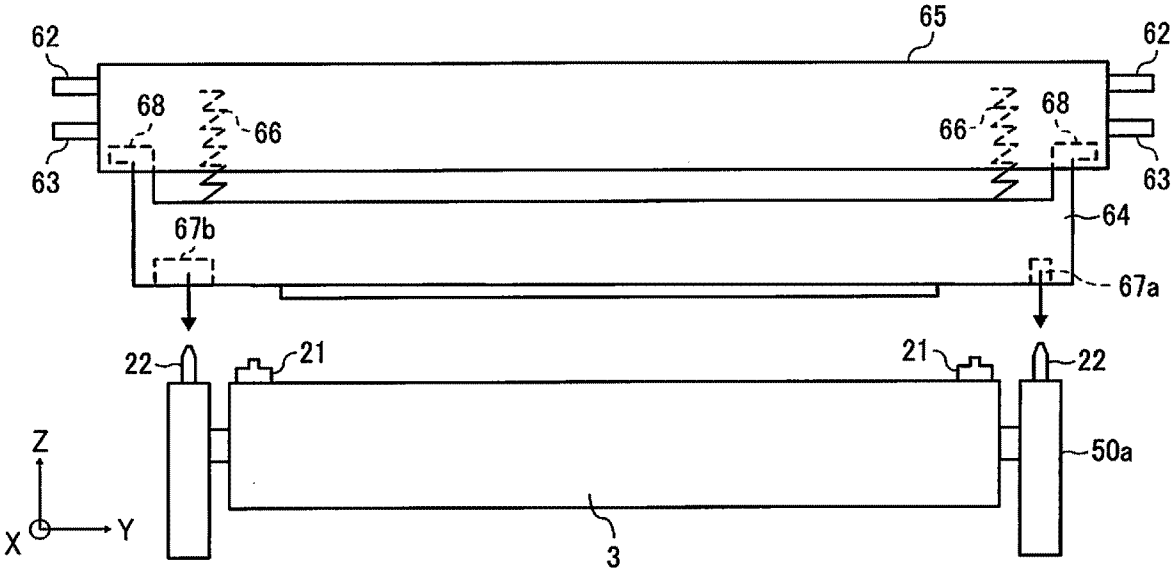
FIG. 2A is a front view illustrating a schematic configuration of an exposure device and adjacent components incorporated in the image forming apparatus of FIG. 1.

FIG. 2A is a front view illustrating a schematic configuration of the exposure device 60 and adjacent components incorporated in the image forming apparatus 1 of FIG. 1. FIG. 2B is a side view illustrating the schematic configuration of the exposure device 60 and the adjacent components incorporated in the image forming apparatus 1 of FIG. 1.

As illustrated in FIGS. 2A and 2B the exposure device 60 includes a writing head 64 and a holder 65.

The writing head (the LED array) 64 that functions as a writing unit includes multiple light emitting elements such as a light emitting diode (LED) array and/or organic electroluminescence (EL) elements arranged in a longitudinal direction of the photoconductor drum 3 and multiple lenses arranged on the photoconductor drum 3 and the multiple light emitting elements.

The holder 65 functions as an exposure device holder (an exposure device holding member) to hold the writing head 64.

The writing head 64 is biased toward the photoconductor drum 3 by springs 66 and is supported by the holder 65. The writing head 64 causes a light emitting element at a predetermined position to emit light based on image data so as to irradiate the photoconductor drum 3 via the lens or lenses. By so doing, the photoconductor drum 3 is exposed to form an electrostatic latent image on a surface of the photoconductor drum 3.

A support projection 62 and a guide projection 63 are vertically disposed at each longitudinal end of the holder 65. The support projection 62 and the guide projection 63 are supported by a retracting unit, which is described below.

Spacers 21 are disposed between the photoconductor drum 3 and the writing head 64. Each of the spacers 21 functions as a regulator to regulate a distance between the photoconductor drum 3 and the writing head 64. The spacers 21 are provided facing the writing head 64 in a non-image forming area of the photoconductor drum 3 and slidable with respect to the photoconductor drum 3.

Positioning bosses 22 are provided at both axial ends of a case 50*a* of the process cartridge 50. A round positioning hole 67*a* is disposed at one axial end (a right end in FIG. 2A) of the writing head 64 as a primary reference for positioning the writing head 64 of the exposure device 60. A rectangular positioning hole 67*b* is disposed at an opposed axial end (a left end in FIG. 2A) of the writing head 64 as a sub or secondary reference for positioning the writing head 64 of the exposure device 60.

Figure 3B:
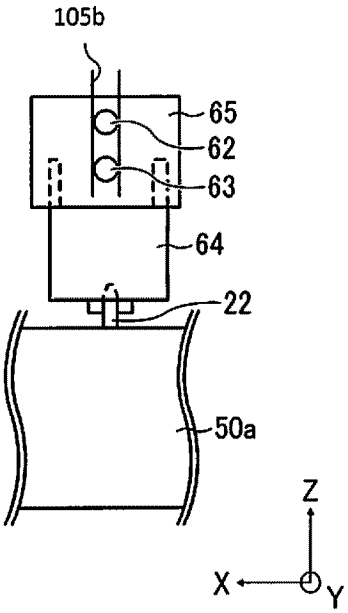
FIG. 3B is a side view illustrating the state in which the exposure device is positioned to the photoconductor drum.
Figure 3A:
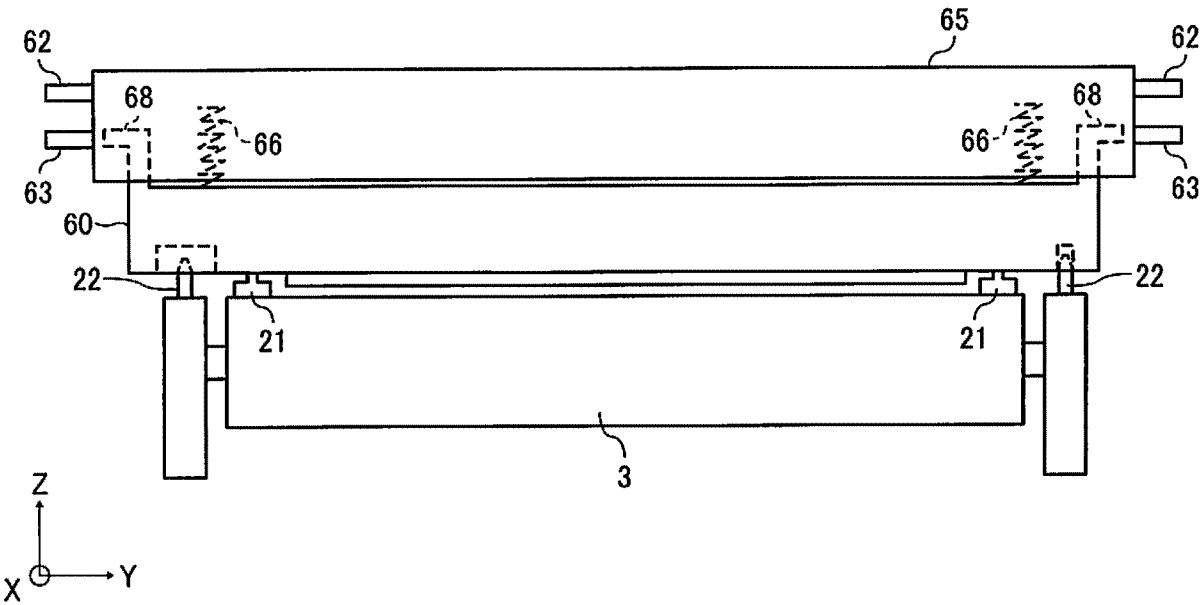
FIG. 3A is a front view illustrating a state in which the exposure device is positioned to a photoconductor drum.

FIG. 3A is a front view illustrating a state in which the exposure device 60 is positioned to the photoconductor drum 3. FIG. 3B is a side view illustrating the state in which the exposure device 60 is positioned to the photoconductor drum 3.

As illustrated in FIGS. 3A and 3B, the respective positioning bosses 22 are fitted to the round positioning hole 67*a* and the rectangular positioning hole 67*b* of the writing head 64, so that the writing head 64 is positioned in a Y-orientation (i.e., an axial direction and a main scanning direction) and an X-orientation (i.e., a sub-scanning direction) in FIG. 3A. Further, the writing head 64 contacts the spacers 21, so that the writing head 64 is positioned in a Z-orientation (i.e., a normal direction of the photoconductor drum 3) in FIG. 3A.

The exposure device 60 is moved by a retracting device 20 (described below) from a retracted position to a latent image forming position. Even after the writing head 64 has contacted one or both of the spacers 21, the holder 65 is moved by the retracting device 20 toward the photoconductor drum 3. Consequently, the springs 66 are compressed and respective movement regulating portions 68 of the writing head 64 separate from the holder 65. As a result, the writing head 64 is pressed against the spacers 21 by respective biasing forces generated by the springs 66.

In order to fit the respective positioning bosses 22 to the round positioning hole 67*a* and the rectangular positioning hole 67*b* of the writing head 64 reliably, a width of an exposure device guide slot 105*b* (see FIGS. 5 and 6) near the latent image forming position is substantially identical to a diameter of the guide projection 63 and a width of the support projection 62. At the latent image forming position, the holder 65 is positioned by the exposure device guide slot 105*b*. By positioning the holder 65 of the exposure device 60 to the exposure device guide slot 105*b*, the holder 65 of the exposure device 60 is prevented from rattling due to vibration caused when forming an electrostatic latent image, and therefore noise in the electrostatic latent image due to the vibration of the holder 65 is prevented. The writing head 64 and the holder 65 have given gutters in the X-orientation and the Y-orientation so that the writing head 64 can be smoothly positioned by the positioning bosses 22 in the X-orientation and the Y-orientation.

Since a focal length of the writing head 64 is short, the exposure device 60 is disposed close to the photoconductor drum 3. This configuration hinders detachment and attachment of the process cartridge 50 with respect to the apparatus body 30.

In order to address this inconvenience, in the present embodiment, the retracting device 20 is provided to the image forming apparatus 1 so that the exposure device 60 can move between the latent image forming position at which the exposure device 60 is located close to the photoconductor drum 3 and the retracted position at which the exposure device 60 is located spaced away from the photoconductor drum 3.

Now, a detailed description is given of the retracting device 20 according to the present embodiment of this disclosure.

Figure 4:
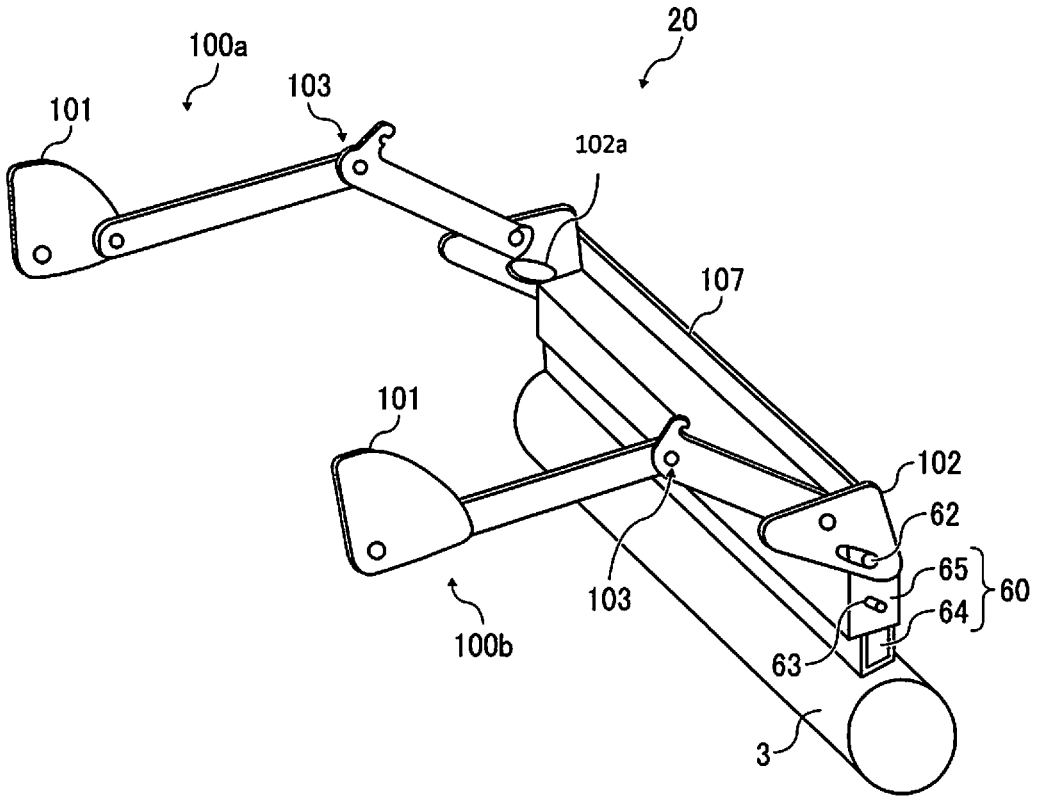
FIG. 4 is a perspective view illustrating a retracting device, the exposure device; and the photoconductor drum.

FIG. 4 is a perspective view illustrating the retracting device 20, the exposure device 60, and the photoconductor drum 3.

As illustrated in FIG. 4, the retracting device 20 includes respective retracting units 100*a* and 100*b* at both longitudinal ends of the exposure device 60. Since the retracting units 100*a* and 100*b* have identical configurations and functions to each other, the retracting units 100*a* and 100*b* are hereinafter referred to in a singular form as the "retracting unit 100" occasionally.

Figure 5:
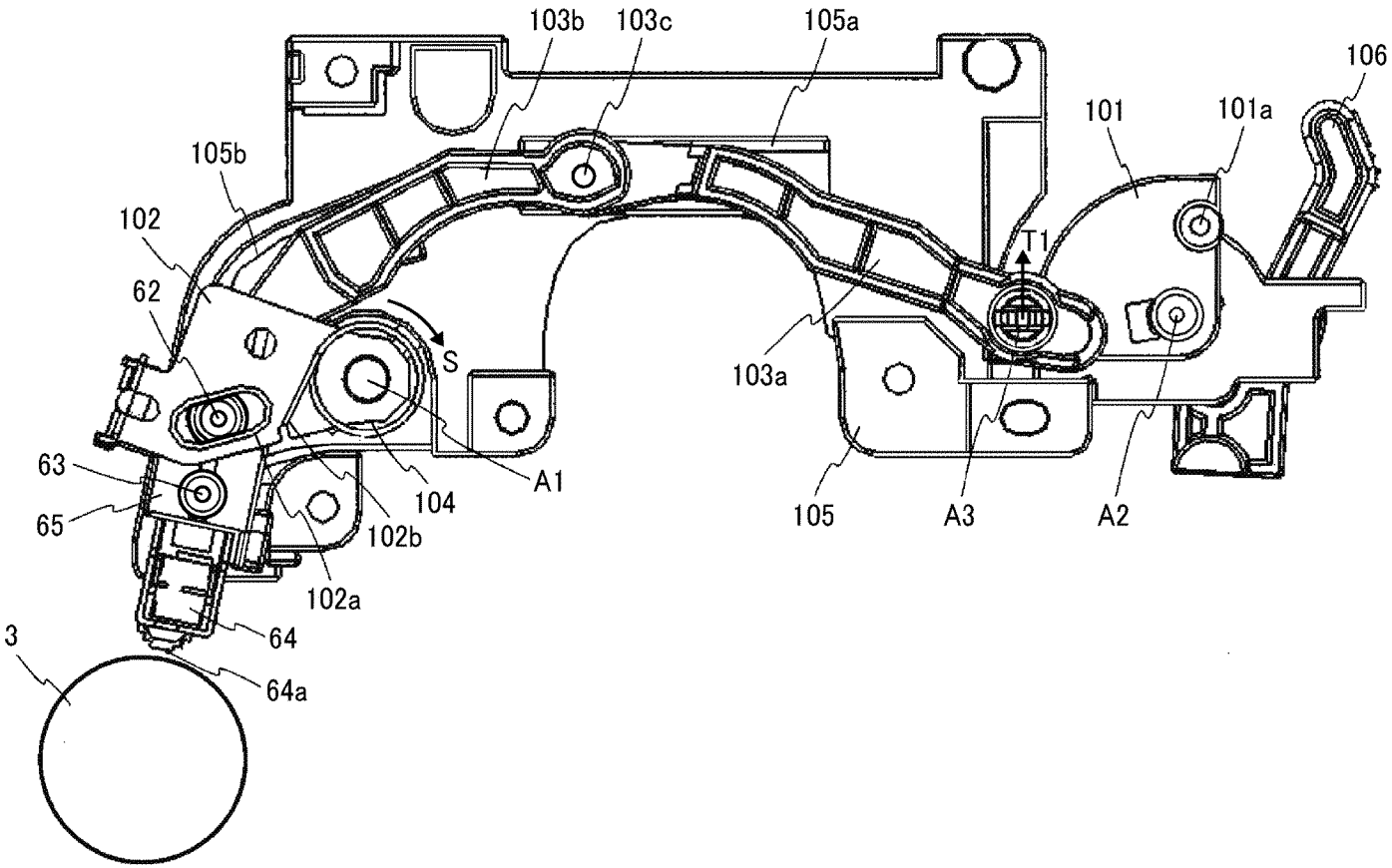
FIG. 5 is a diagram illustrating a schematic configuration of a retracting unit provided to the retracting device of FIG. 4.

FIG. 5 is a diagram illustrating a schematic configuration of the retracting unit 100 provided to the retracting device 20 of FIG. 4. Specifically, in FIG. 5, the exposure device 60 is located at the latent image forming position where an electrostatic latent image is formed on the surface of the photoconductor drum 3. Hereinafter, the latent image forming position is also referred to as an "exposure position".

As illustrated in FIG. 5, the retracting unit 100 that functions as a moving unit includes a first link unit 101, a second link unit 102, and a connecting unit 103. The first link unit 101 is rotatably supported by the apparatus body 30 of the image forming apparatus 1. The second link unit 102 that functions as a holder to hold the exposure device 60. The second link unit 102 is rotatably supported by the apparatus body 30 of the image forming apparatus 1. The connecting unit 103 functions as a connector to connect the first link unit 101 and the second link unit 102.

The connecting unit 103 includes a first connecting member 103*a* and a second connecting member 103*b*. One end of the first connecting member 103*a* is rotatably supported by the first link unit 101 and an opposed end of the first connecting member 103*a* is rotatably supported by a connecting shaft 103*c*. One end of the second connecting member 103*b* is rotatably supported by the connecting shaft 103*c* and an opposed end of the second connecting member 103*b* is rotatably supported by the second link unit 102. The connecting shaft 103*c* passes through a connection guide hole 105*a* formed in a cover unit 105. The connection guide hole 105*a* extends in left and right side directions in FIG. 5.

Figure 6:
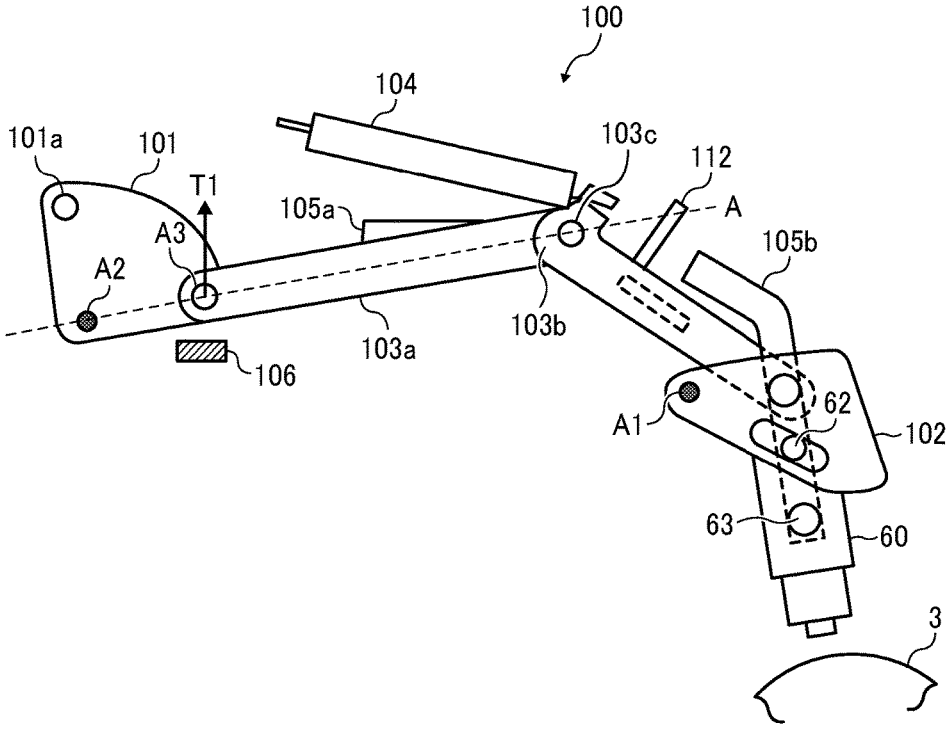
FIG. 6 is a diagram illustrating a schematic configuration of the retracting unit in a state in which the exposure device is positioned to an exposure position.
Figure 7:
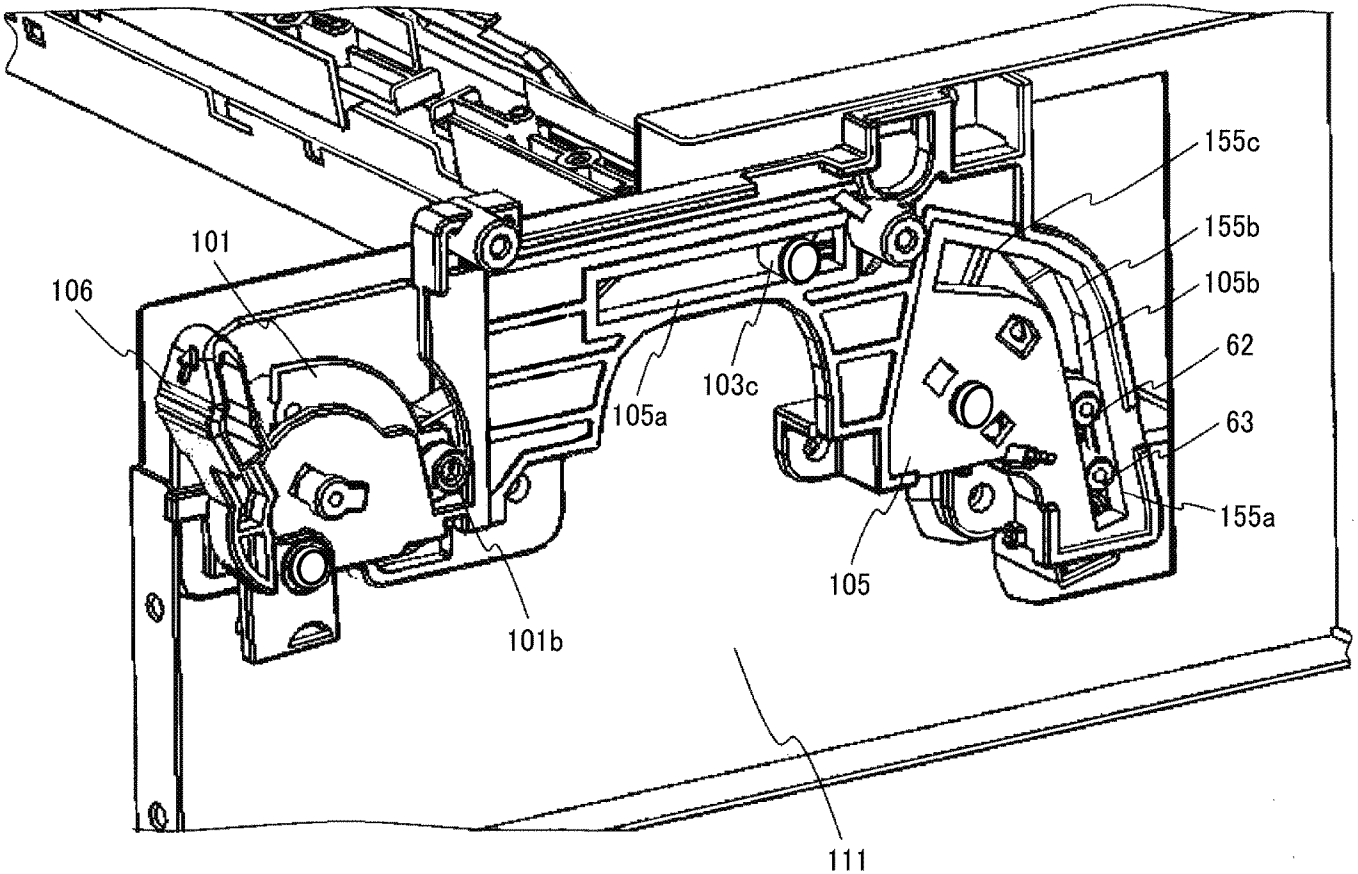
FIG. 7 is a perspective view illustrating a schematic configuration of the retracting unit covered by an apparatus body side plate and a cover unit.

FIG. 6 is a diagram illustrating a schematic configuration of the retracting unit 100 in a state in which the exposure device 60 is positioned to the exposure position. FIG. 7 is a perspective view illustrating a schematic configuration of the retracting unit 100 covered by an apparatus body side plate 111 and the cover unit 105.

The second link unit 102 has a support slot 102*a* that is an elongated hole extending toward a rotational support A1 of the second link unit 102. A support projection 62, which is provided on both ends in a longitudinal direction of the holder 65 of the exposure device 60, passes through the support slot 102*a*. By causing the support projection 62 of the holder 65 of the exposure device 60 to pass through the support slot 102*a*, the exposure device 60 is supported by the retracting unit 100.

As illustrated in FIGS. 6 and 7, the support projection 62 also passes through the exposure device guide slot 105*b* that functions as a guide provided to the cover unit 105. Further, the holder 65 of the exposure device 60 includes the guide projection 63 that passes through the exposure device guide slot 105*b*.

The first link unit 101 is a fan-shaped unit having a central angle of approximately 90 degrees. The first connecting member 103*a* is rotatably supported at one end in a circumferential direction of the first link unit 101. A boss section 101*a* is disposed at an opposed end in the circumferential direction of the first link unit 101.

A hook 102*b* is disposed at the second link unit 102. The hook 102*b* functions as a biasing member to hook one end of a torsion spring 104. One end of the torsion spring 104 is hooked to the hook 102*b* and an opposed end of the torsion spring 104 is hooked to the cover unit 105. By so doing, the torsion spring 104 biases the second link unit 102 to a direction indicated by arrow S illustrated in FIG. 5.

Due to a biasing force generated by the torsion spring 104, the second link unit 102 and the connecting shaft 103*c* (i.e., the first connecting member 103*a* and the second connecting member 103*b*) receive respective forces to move to the first link unit 101. At this time, a first link unit support position A3 of the first connecting member 103*a* is located below a line segment A connecting a rotational support A2 of the first link unit 101 and the connecting shaft 103*c* in FIG. 5. Consequently, a force applied to move the connecting shaft 103*c* to the first link unit 101 generates a force to move to the first link unit support position A3 in a direction indicated by arrow T1 in FIGS. 5 and 6. As a result, a force to move the first link unit 101 in a counterclockwise direction is generated. Accordingly, the exposure device 60 is biased toward the photoconductor drum 3, so that the exposure device 60 is located at the latent image forming position by biasing the exposure device 60 by the force toward the photoconductor drum 3 together with a biasing force of the springs 66 in the writing head 64.

In the present embodiment, the exposure device 60 is biased by the torsion spring. However, the same serial operations can be achieved by pulling the second connecting member 103*b* using the torsion spring as illustrated in FIG. 6.

Further, in the present example, the respective retracting units 100 (i.e., the retracting units 100*a* and 100*b*) are provided at both ends of the exposure device 60, as illustrated in FIG. 4. Providing the retracting units 100 at both ends of the exposure device 60 according to the present embodiment can prevent deviation of time in movements of both ends of the exposure device 60.

Further, a single retracting unit 100, i.e., either one of the retracting units 100*a* and 100*b*, may be disposed at either of the one end side and the opposed end side of the exposure device 60. In this case, the deviation of time in movements of the one end side and the opposed end side of the exposure device 60 is increased, however, the image forming apparatus 1 can achieve a reduction in the manufacturing cost.

Further, as illustrated in FIG. 4, one end side of the retracting unit 100*a* and an opposed end side of the retracting unit 100*b* are connected by a retracting unit connecting member 107. Specifically, the retracting unit connecting member 107 connects the second link unit 102 of the retracting unit 100 (i.e., the retracting unit 100*a*) at the one end side of the exposure device 60 and the second link unit 102 of the retracting unit 100 (i.e., the retracting unit 100*b*) at the opposed end side of the exposure device 60. By so doing, the retracting unit 100*a* at the one end side of the exposure device 60 and the retracting unit 100*b* at the opposed end side of the exposure device 60 move together with each other, and therefore occurrence of deviation of time between movement of the retracting unit 100*a* and the retracting unit 100*b* can be prevented. The retracting unit connecting member 107 may be the same member as the second link unit 102.

When the process cartridge 50 is attached to or inserted into the apparatus body 30 of the image forming apparatus 1, the process cartridge 50 is likely to contact or hit the exposure device 60 located at the retracted position, resulting in damage or breakage of the exposure device 60. Further, it is likely that a user touches the exposure device 60 by inserting the hand through an opening area of the cover 91 when the cover 91 is left open.

Figure 9:
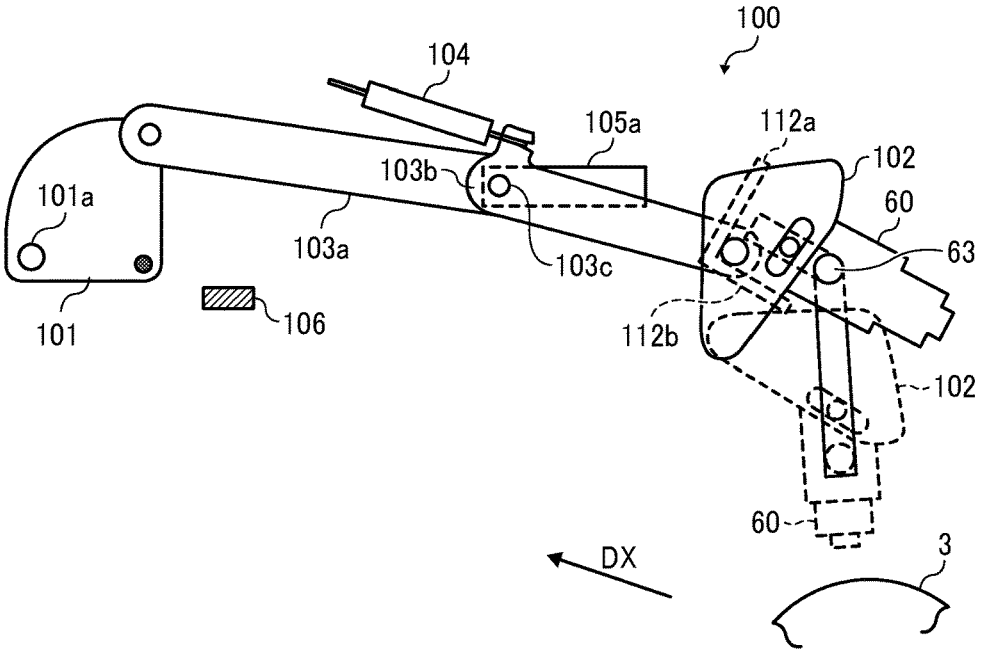
FIG. 9 is a diagram illustrating the retracting unit when the exposure device is located at the retracted position.

In order to address the above-described inconveniences, a protection member 112 is provided to protect the exposure device 60 at the retracted position. The protection member 112 extends in the longitudinal direction of the exposure device 60. Both one end and an opposed end of the protection member 112 are secured to a side plate provided at one end of the apparatus body 30. As illustrated in FIGS. 6 and 9, the protection member 112 includes a first face 112*a* and a second face 112*b* that extends in a direction perpendicular to the first face 112*a*. In other words, the first face 112*a* and the second face 112*b* form a substantially L-shape in cross section, for example, so as to protect the exposure device 60 from the above-described inconveniences. The first face 112*a* is disposed facing a face of the exposure device 60 on the side of the cover 91 when the exposure device 60 is located at the retracted position. The second face 112*b* is disposed such that a detaching area of the process cartridge 50 and the exposure device 60 located at the retracted position are partitioned.

Further, as illustrated in FIG. 7, an apparatus body side plate 111 and the cover unit 105 cover the first link unit 101, the first connecting member 103*a*, and the second connecting member 103*b*. Consequently, this configuration can prevent a user from touching the first link unit 101, the first connecting member 103*a*, and the second connecting member 103*b* when the cover 91 is opened. Therefore, the configuration can prevent the user from moving the exposure device 60 from the retracted position to the latent image forming position. Accordingly, the exposure device 60 is located at the image forming position when the process cartridge 50 is attached to the apparatus body 30, which can prevent exposure device 60 from contacting or hitting the process cartridge 50.

Further, the cover unit 105 is provided with the connection guide hole 105*a* that guides the connecting shaft 103*c* and the exposure device guide slot 105*b* that guides the support projection 62 and the guide projection 63.

Next, a description is given of movement of the exposure device 60 between the latent image forming position and the retracted position with reference to FIGS. 8 through 11.

Figure 8:
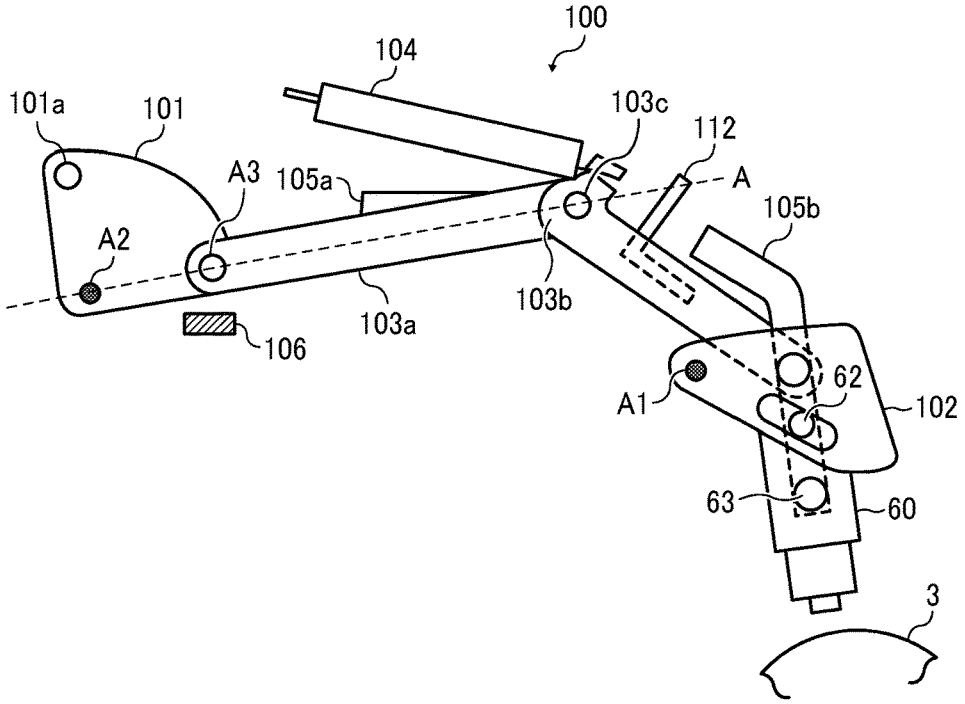
FIG. 8 is a diagram illustrating the retracting unit while moving the exposure device from a latent image forming position (the exposure position) to a retracted position.
Figure 10:
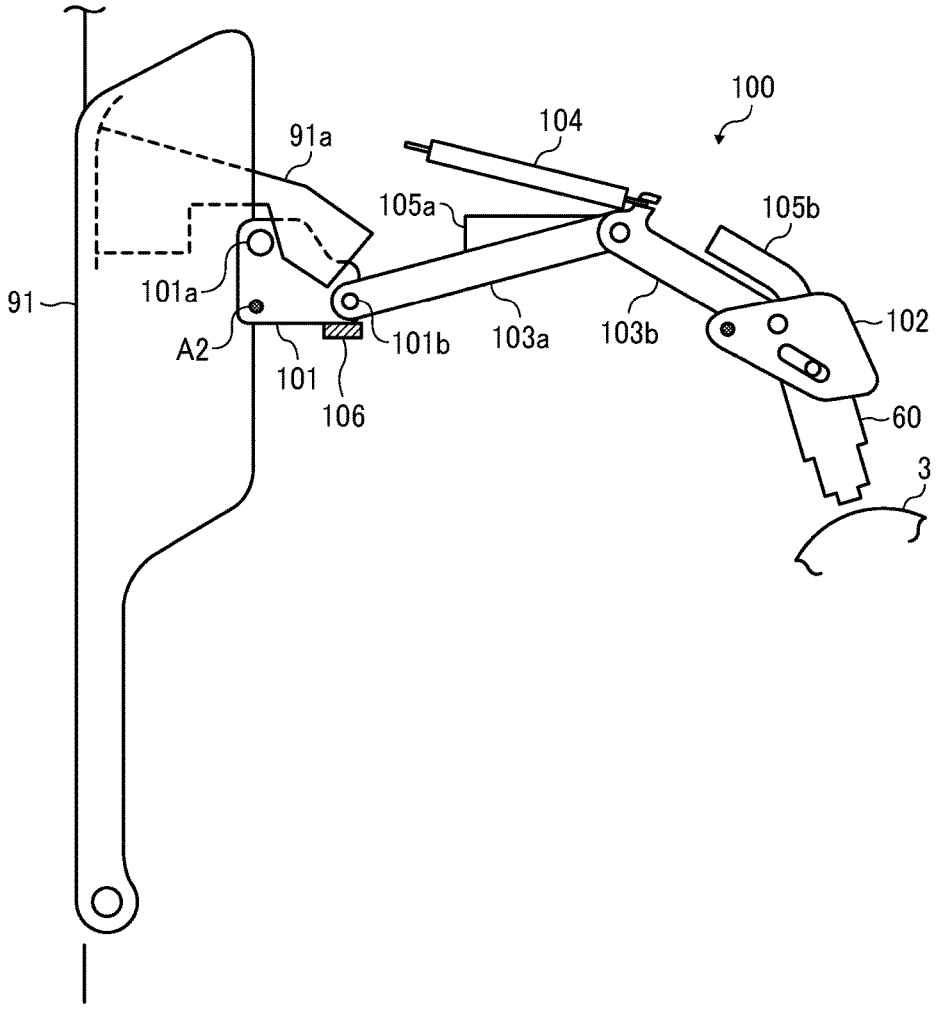
FIG. 10 is a diagram illustrating a relation of a first link unit of the retracting unit and a cover when the exposure device is to be moved from the latent image forming position to the retracted position.
Figure 11:
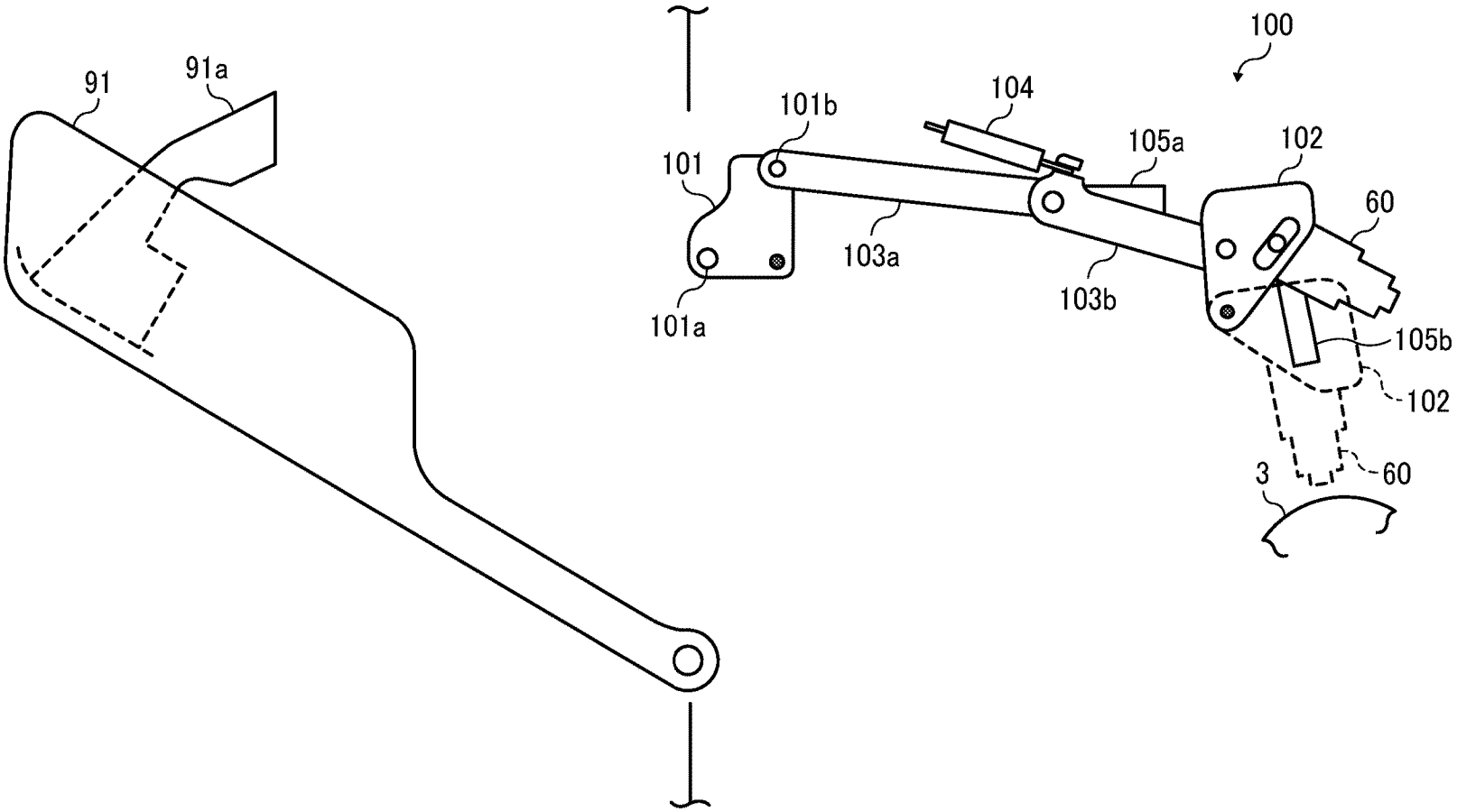
FIG. 11 is a diagram illustrating the relation of the first link unit of the retracting unit and the cover when the exposure device is moved from the latent image forming position to the retracted position.

FIG. 8 is a diagram illustrating the retracting unit 100 while moving the exposure device 60 from the latent image forming position (i.e., the exposure position) to the retracted position. FIG. 9 is a diagram illustrating the retracting unit 100 when the exposure device 60 is located at the retracted position. FIG. 10 is a diagram illustrating a relation between the first link unit 101 of the retracting unit 100 and the cover 91 when the exposure device 60 that is closed is to be moved from the latent image forming position to the retracted position. FIG. 11 is a diagram illustrating the relation between the first link unit 101 of the retracting unit 100 and the cover 91 when the exposure device is moved from the latent image forming position to the retracted position and is opened.

As illustrated in FIG. 10, the cover 91 includes a hooking lever 91*a* that functions as a hook-shaped acting member to hook the boss section 101*a* of the first link unit 101.

When the cover 91 is closed and the exposure device 60 is located at the latent image forming position, the hooking lever 91*a* is disposed separated away from the boss section 101*a*.

As the cover 91 opens, the hooking lever 91*a* contacts the boss section 101*a*, and the first link unit 101 turns in the counterclockwise direction in FIG. 10. At this time, the first link unit 101 is biased by the torsion spring 104 in an opposite direction to the turning direction (the counterclockwise direction in FIG. 10) of the first link unit 101 via the connecting unit 103. Therefore, at this time, the hooking lever 91*a* turns the first link unit 101 against a biasing force exerted by the torsion spring 104.

When the first link unit 101 is turned to a position illustrated in FIG. 10 against the biasing force applied by the torsion spring 104, the first link unit support position A3 of the first connecting member 103*a* of the first link unit 101 comes on the line segment A connecting the rotational support A2 of rotation of the first link unit 101 and the connecting shaft 103*c*, as illustrated in FIG. 7. Before the first link unit support position A3 of the first connecting member 103*a* reaches the line segment A, the connecting shaft 103*c* moves in a direction separating from the first link unit 101. As a result, the holder 65 of the exposure device 60 presses the spring 66, and therefore the exposure device 60 moves from the latent image forming position to the position close to the photoconductor drum 3, as illustrated in FIGS. 3A and 3B. As illustrated in FIG. 3B, when the exposure device 60 is at the latent image forming position, a predetermined gap or space is provided between the guide projection 63 and an end of the exposure device guide slot 105*b* on a side of the photoconductor drum 3. Therefore, until arrival of the first link unit support position A3 of the first connecting member 103*a* to the line segment A, the holder 65 can move from the latent image forming position to the position close to the photoconductor drum 3.

As the hooking lever 91*a* further turns the first link unit 101 in the counterclockwise direction in the state in which the first link unit support position A3 of the first connecting member 103*a* has reached the line segment A, the first link unit support position A3 of the first connecting member 103*a* moves above the line segment A in FIG. 8. In response to this action, the force applied by the torsion spring 104 to move the connecting shaft 103*c* toward the first link unit 101 (to the left side in FIG. 8) generates a force to move the connecting shaft 103*c* upwardly at the first link unit support position A3. Consequently, the first link unit 101 is biased to a direction to turn the first link unit 101 to move the exposure device 60 to the retracted position by the torsion spring 104 via the connecting unit 103 (the counterclockwise direction in FIG. 8). As a result, the first link unit 101 automatically turns in the direction to move the exposure device 60 toward the retracted position by the biasing force applied by the torsion spring 104 (the counterclockwise direction in FIG. 8), and therefore the exposure device 60 moves to the retracted position.

Further, with rotation of the first link unit 101 in the counterclockwise direction, the connecting shaft 103*c* is guided by the connection guide hole 105*a* to move toward the cover 91 (the left side in FIG. 8). Then, the second connecting member 103*b* also moves toward the cover 91 (the left side in FIG. 8), and therefore the second link unit 102 turns in the counterclockwise direction about the rotational support A1. Thereafter, the support projection 62 and the guide projection 63 of the exposure device 60, both of which pass through the support slot 102*a* of the second link unit 102, are elevated in a direction to separate from the photoconductor drum 3 while being guided by the exposure device guide slot 105*b*.

The support slot 102*a* that supports the support projection 62 of the second link unit 102 has a long hole shape extending toward the rotational support A1. According to this form of the support slot 102*a*, the exposure device 60 does not move on a track of an arc but moves linearly in the normal direction of the photoconductor drum 3 from the latent image forming position to the retracted position while being guided by the exposure device guide slot 105*b*.

Thus, in the present embodiment, the exposure device 60 moves from the latent image forming position to the retracted position linearly in the normal direction of the photoconductor drum 3. Therefore, even if the charging roller 4 and the developing device 2 are disposed close to the exposure device 60, the charging roller 4 and the developing device 2 do not obstruct movement of the exposure device 60 from the latent image forming position indicated by broken lines in FIG. 9 to the retracted position indicated by solid lines in FIG. 9.

As illustrated in FIG. 7, the exposure device guide slot 105*b* includes a first straight part 155*a*, a curved part 155*b*, and a second straight part 155*c*. The first straight part 155*a* extends linearly in the normal direction of the photoconductor drum 3. The second straight part 155*c* extends linearly in a diagonally upward left in FIG. 7. The curved part 155*b* is a portion having a small radius of curvature and connecting the first straight part 155*a* and the second straight part 155*c*. The second straight part 155*c* extends substantially parallel to a detaching direction of the process cartridge 50 as indicated by arrow DX illustrated in FIG. 9. Therefore, when the support projection 62 is guided to the curved part 155*b* of the exposure device guide slot 105*b*, the exposure device 60 turns in the counterclockwise direction in FIG. 13 about the guide projection 63, resulting in a change of the position of the exposure device 60. Then, as illustrated in FIG. 9, when the guide projection 63 reaches the second straight part 155*c* of the exposure device guide slot 105*b*, the exposure device 60 changes to a retracted attitude that extends parallel to the detaching direction of the process cartridge 50.

Thus, in the present embodiment, the exposure device 60 is moved linearly in the normal direction of the photoconductor drum 3 and then is rotated to the retracted attitude extending substantially parallel to the detaching direction of the process cartridge 50. By so doing, an amount of vertical movement of the exposure device 60 (in FIG. 9) to the retracted position where the exposure device 60 does not hinder detachment and attachment of the process cartridge 50 can be more reduced when compared to a case in which the exposure device 60 is not rotated. Accordingly, vertical space in FIG. 9 in which the exposure device 60 moves between the latent image forming position and the retracted position can be reduced and, as a result, a reduction in size of the image forming apparatus 1 can be achieved.

Embodiment 1

Next, a description is given of the exposure device 60 regarding cleaning of a lens surface 64*a* of the exposure device 60, according to Embodiment 1 of this disclosure.

Figure 12:
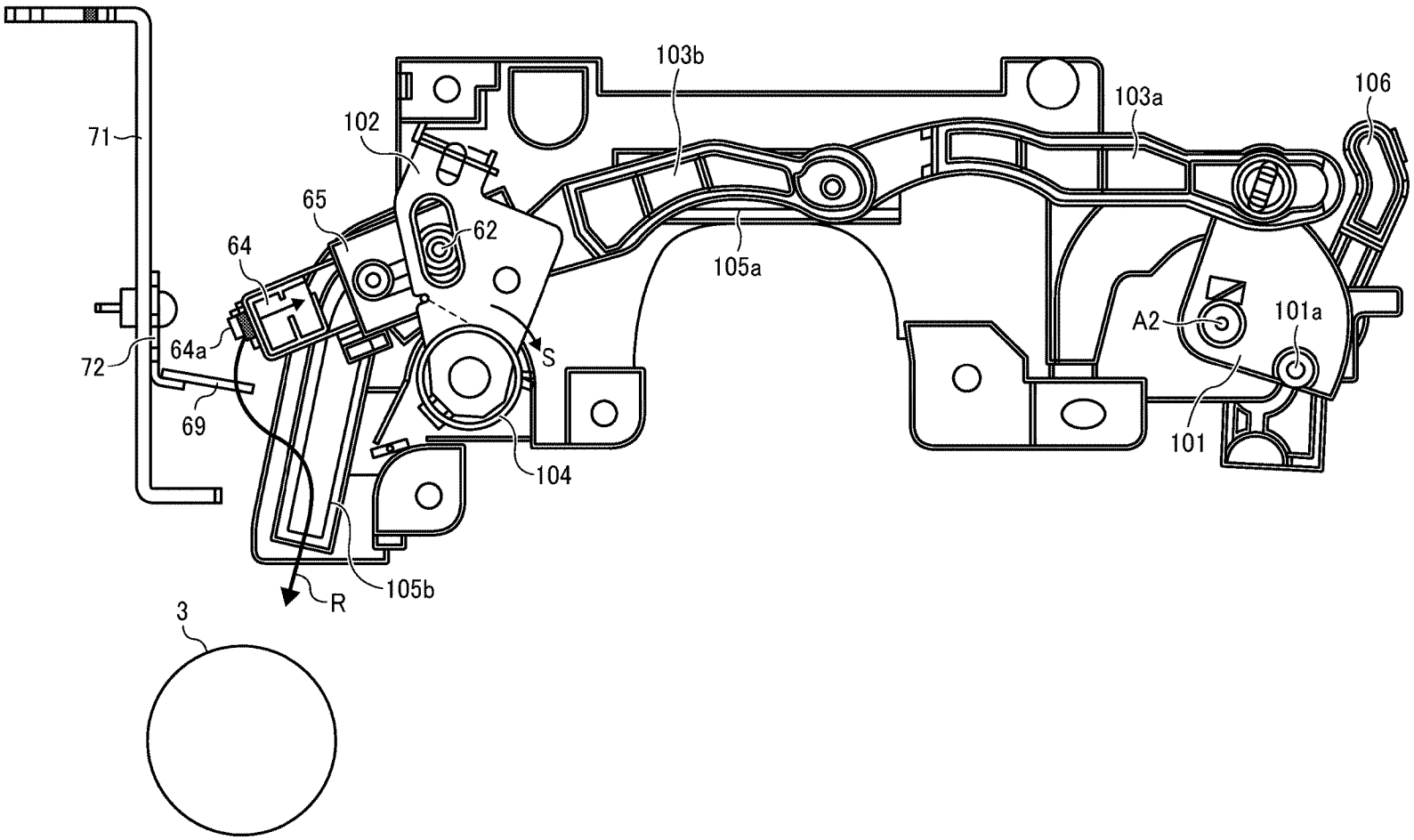
FIG. 12 is a diagram illustrating a configuration in which a cleaning member that cleans a lens surface of the exposure device is disposed on a retraction path of the exposure device.

FIG. 12 is a diagram illustrating a configuration in which a cleaning member 69 that cleans the lens surface 64*a* of the exposure device 60 is disposed on a retraction path R of the exposure device 60. The cleaning member 69 is flexible in shape so that the cleaning member 69 contacts the lens surface 64*a* of the exposure device 60 to tilt a cleaning face forming portion thereof. As illustrated in FIG. 12, as the cover 91 opens and closes, the exposure device 60 moves from the exposure position to the retracted position along the retraction path R that draws a straight line trajectory and a curved trajectory.

In Embodiment 1, the cleaning member 69 is an elastic member and is disposed at a position along the curved trajectory of the retraction path R. When the exposure device 60 moves from the retracted position to the exposure position, the lens surface 64*a* is pressed against the cleaning member 69. By so doing, foreign material such as toner and dust is brought from the lens surface 64*a* to the cleaning member 69. Accordingly, foreign material on the lens surface 64*a* can be removed. The cleaning member 69 is a flexibly bendable member, for example, a non-woven cloth as a fabric member attached to a thin mylar as a base material or a brush. Alternatively, a member including a sponge seal member can be replaced with the above-described members. The cleaning member 69 is fixed to a holding member 72 with a double sided tape. The holding member 72 is an L-shaped member fixed to an apparatus body stay 71, for example, with screws.

Figure 13C:
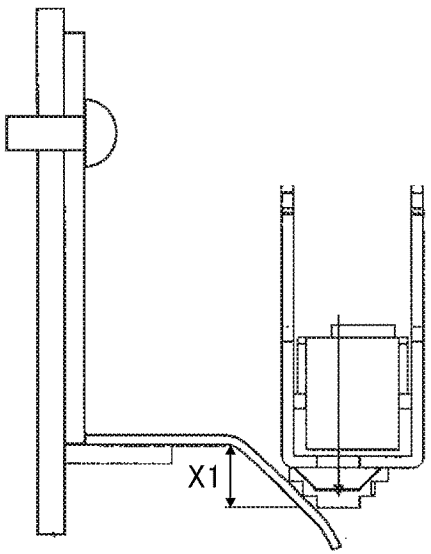
FIGS. 13A, 13B and 13C are diagrams illustrating a comparative cleaning process in which the exposure device is cleaned by contacting the cleaning member while moving on a straight line trajectory of the retraction path of the exposure device.
Figure 13B:
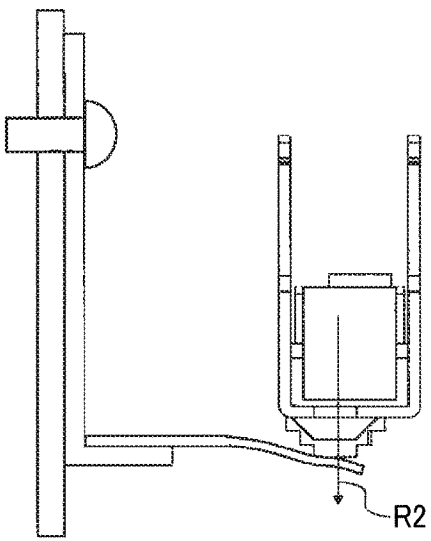
Figure 13A:
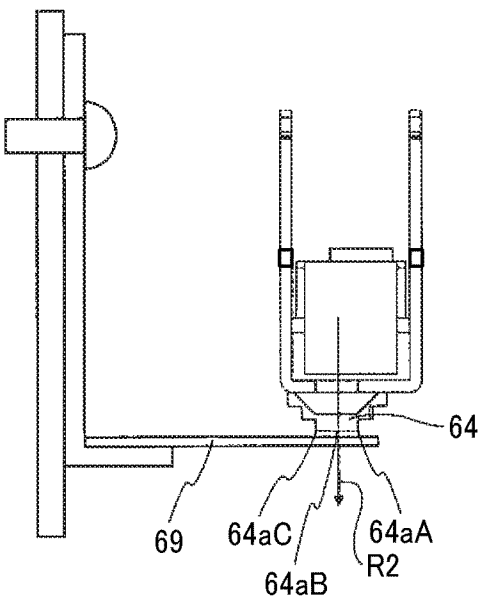

Now, a description is given of a comparative configuration in which the cleaning member 69 that is an elastic member disposed at a position along the straight line trajectory of the retraction path R, with reference to FIGS. 13A, 13B, and 13C.

FIGS. 13A, 13B and 13C are diagrams illustrating a comparative cleaning process in which the exposure device 60 is cleaned by contacting the cleaning member 69 while moving on a straight line trajectory of the retraction path R.

In the comparative configuration with reference to FIGS. 13A through 13C, the surface 64*a* of the exposure device 60 includes a right side end position 64*a*A, a center position 64*a*B, and a left side end position 64*a*C. Further, the exposure device 60 in the comparative configuration moves along a retraction path R2.

In FIG. 13A, the exposure device 60 starts to contact the cleaning member 69. In this state, the entire face of the lens surface 64*a* contacts the cleaning member 69. As the exposure device 60 moves from the state toward a downward direction, the cleaning member 69 deforms and a reaction force generated due to the deformation of the cleaning member 69 is applied on the exposure device 60 in an upward direction. Due to a force of elasticity of the cleaning member 69 (hereinafter, referred to as a "cleaning pressure") and substantial left and right (horizontal) movement of the exposure device 60 caused by vertical shift of the exposure device 60 and deformation of the cleaning member 69, the cleaning member 69 catches foreign material attached to the lens surface 64*a*. The substantial left and right movement of the exposure device 60 indicates an action, for example, that, as the left side end position 64*a*C of the lens surface 64*a* of the exposure device 60 moves downwardly, the cleaning member 69 in contact with the lens surface 64*a* shifts from a position directly below to a right side position.

When the exposure device 60 firstly contacts the cleaning member 69, each of the right side end position 64*a*A, the center position 64*a*B, and the left side end position 64*a*C of the lens surface 64*a* contacts the cleaning member 69. As the cleaning member 69 deforms, the cleaning pressure is applied on the cleaning member 69. However, as the degree of deformation of the cleaning member 69 increases, the right side end position 64*a*A of the lens surface 64*a* and the cleaning member 69 separate from each other, as illustrated in FIG. 13B.

In a case in which the cleaning member 69 does not have stiffness, the cleaning member 69 deforms along the lens surface 64*a*. However, a certain amount of stiffness is applied to the cleaning member 69 so as to exert the cleaning pressure. Therefore, as the degree of deformation of the cleaning member 69 increases, the lens surface 64*a* separates from the cleaning member 69 from the right side end position 64*a*A.

By contrast, the left side end position 64*a*C of the lens surface 64*a* remains in contact with the cleaning member 69 until further deformation of the cleaning member 69. Since the left side end position 64*a*C receives the cleaning pressure to be cleaned, the lens surface 64*a* receives a greater cleaning pressure for a long period of time. Accordingly, the degree (strength) and the period of time of the cleaning pressure to be applied to the lens surface 64*a* become different depending on the position of the lens surface 64*a*, and therefore the cleaning ability of the cleaning member 69 does not remain constant. Specifically, some areas on the lens surface 64*a* are cleaned while other areas on the lens surface 64*a* are not cleaned. In this case, the cleaning pressure at the right side end position 64*a*A of the lens surface 64*a* is smaller than the cleaning pressure at the left side end position 64*a*C of the lens surface 64*a*. That is, the cleaning ability of at the left side end position 64*a*C of the lens surface 64*a* is worse than the cleaning ability at the left side end position 64*a*C of the lens surface 64*a*. However, in a case in which the stiffness of the cleaning member 69 is increased to provide a greater cleaning pressure in order to clean the right side end position 64*a*A of the lens surface 64*a* appropriately, a degree of load applied on the exposure device 60 increases. As a result, opening and closing of the cover that is linked to a retraction movement of the exposure device 60 can be slower.

By contrast, in Embodiment 1, the lens surface 64*a* contacts the cleaning member 69 while the exposure device 60 is moving along the curved trajectory. By so doing, the above-described inconvenience can be prevented.

Figure 14A:
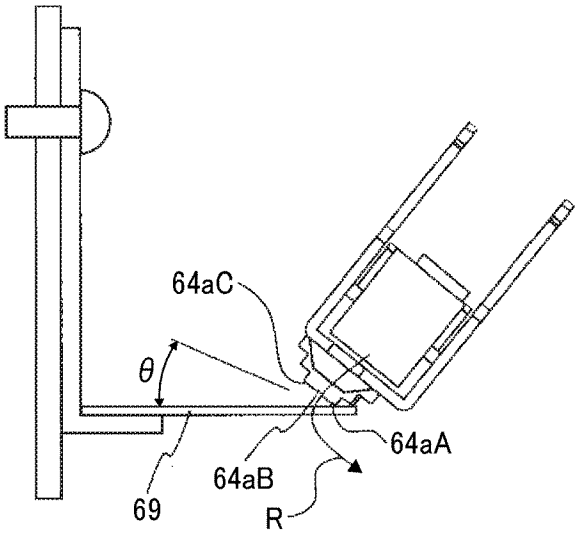
FIGS. 14A, 14B and 14C are diagrams illustrating changes of state in which the lens surface contacts a cleaning face of the cleaning member when the cleaning member disposed on a curved trajectory of the retraction path of the exposure device.
Figure 14B:
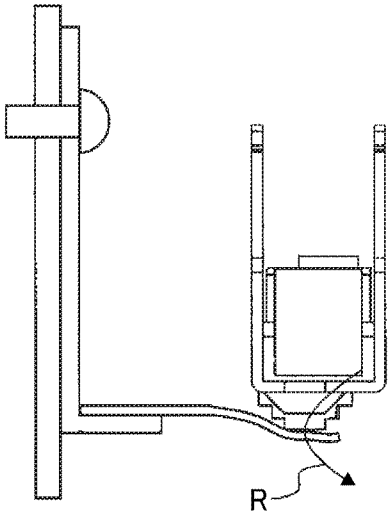
Figure 14C:
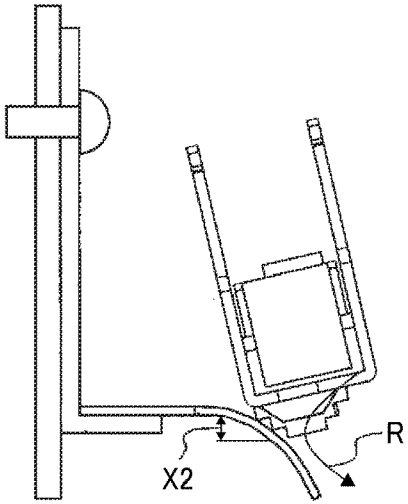

FIGS. 14A, 14B, and 14C are diagrams illustrating changes of state in which the lens surface 64*a* contacts the cleaning face of the cleaning member 69 when the cleaning member disposed on the curved trajectory of the retraction path R of the exposure device 60.

As illustrated in FIGS. 14A through 14C, the cleaning face of the cleaning member 69 and the lens surface 64*a* of the exposure device 60 form an angle θ in FIGS. 14A through 14C (in cross section in a main scanning direction). The angle θ of the cleaning face of the cleaning member 69 and the lens surface 64*a* of the exposure device 60 changes while the lens surface 64*a* is contacting the cleaning member 69. More specifically, when the lens surface 64*a* starts to contact the cleaning member 69, the right side end position 64*a*A of the lens surface 64*a* contacts the cleaning member 69, as illustrated in FIG. 14A. As the trajectory of the exposure device 60 gradually moves, the entire face of the lens surface 64*a* contacts the cleaning member 69, as illustrated in FIG. 14B. As the trajectory of the exposure device 60 moves further, the left side end position 64*a*C of the lens surface 64*a* contacts the cleaning member 69, as illustrated in FIG. 14C. In a case in which light of the lens of the exposure device 60 is reflected on a curved surface, the lens surface 64*a* that defines the angle θ is a plane that contacts the lens surface at an intersecting point of centers of optical axes on the surface of the lens.

In Embodiment 1, the exposure device 60 rotates with small deformation of the cleaning member 69. That is, the substantial left and right movement of the exposure device 60 is performed. As described above with FIG. 13C, an amount of deformation of the cleaning member 69 when the position of the left side end position 64*a*C of the lens surface 64*a* of the exposure device 60 starts to separate from the cleaning member 69 is indicated by a deformation amount X1. By contrast, in FIG. 14C where the curved trajectory is employed to the exposure device 60, the amount of deformation of the cleaning member 69 is indicated by a deformation amount X2. Accordingly, the amount of deformation of the cleaning member 69 (i.e., the deformation amount X2) illustrated in FIG. 14C is smaller than the amount of deformation of the cleaning member 69 (i.e., the deformation amount X1) illustrated in FIG. 13C. The cleaning pressure of the cleaning member 69 changes according to the amount of deformation of the cleaning member 69. Therefore, when the amount of deformation of the cleaning member 69 is reduced, the change of cleaning pressure of the cleaning member 69 is smaller. As a result, a difference of the cleaning performance on the lens surface 64*a* of the exposure device 60 can be reduced, and therefore the cleaning performance of the cleaning member 69 can be enhanced.

Further, in Embodiment 1, the cleaning member 69 is disposed at a position between the positioning of the exposure device 60 to the photoconductor drum 3 and the retraction of the exposure device 60. However, the retraction movement of the exposure device 60 is linked to the opening and closing of the cover 91. Therefore, the cleaning is automatically performed by the movement (opening and closing) of the cover 91. An image formation PCDU (photoconductor development unit) and a conveyance passage arranged inside the cover 91. The cover 91 is opened and closed when removing jammed sheets or replacing process cartridges. With the action of the cover 91, the exposure device 60 is automatically cleaned. Accordingly, a good performance of maintenance is achieved.

In order to clean the exposure device 60 by an action other than the movement of opening and closing of the cover 91, a cleaning lever 106 is provided next to the first link unit 101, as illustrated in FIGS. 5, 7, and 12. The cleaning lever 106 is rotatably held by the cover unit 105. By rotating the cleaning lever 106, the cleaning lever 106 contacts a boss section 101*b* of the first link unit 101 to press the first link unit 101. Accordingly, the first link unit 101 is rotated. Along with rotation of the first link unit 101, the exposure device 60 moves from the retracted position to the exposure position. In the process of movement of the exposure device 60, the exposure device 60 contacts the cleaning member 69, and therefore the exposure device 60 is cleaned. The cleaning lever 106 is disposed at a position to be seen when the cover 91 is open. By pressing the cleaning lever 106 when the exposure device 60 is located at the retracted position, the exposure device 60 moves to the exposure position through the retracting unit 100. When the pressing of the cleaning lever 106 is stopped in the middle of the movement of the exposure device 60 to the exposure position, the exposure device 60 returns to the retracted position due to the biasing force of the torsion spring 104. That is, by repeatedly pressing the cleaning lever 106, the exposure device 60 contacts the cleaning member 69 by the number of repetition of pressing of the cleaning lever 106. Accordingly, in a case in which a large amount of foreign materials is attached to the exposure device 60, the exposure device 60 can be cleaned more easily than the action of opening and closing of the cover 91.

It is to be noted that there is another comparative configuration in which an angle formed between an exposing member and a cleaning member changes. In this comparative configuration, the cleaning member and the exposing member are fixed to the same cover, and therefore move together as a single unit. Due to this configuration, foreign material remains on the cleaning member even after cleaning of the exposing member. Since the exposing member reciprocates between a positioning position and a retracted position together with the cleaning member having the foreign materials thereon, it is likely that the foreign materials scatter and fly. As described above, the exposing member and the cleaning member are fixed to and move together with the same cover. Since airflow that occurs when the cover is moving to a closed position is large, when the airflow hits the cleaning member, the collected foreign materials are scattered to contaminate the inside of an image forming apparatus.

Further, in the comparative configuration, the cleaning member and the exposing member are retracted by opening a top cover, and therefore the cleaning member is brought to be exposed to the outside of the image forming apparatus. Consequently, outside dust is attached to the cleaning member, and it is likely that the duct contaminates the inside of the image forming apparatus when the top cover is open or that the exposing member is contaminated by the dust that is transferred from the cleaning member.

By contrast, in the present embodiment, the cleaning member 69 does not retract together with the exposure device 60. Therefore, it is not likely that the dust scatters or flies to contaminate the inside of the image forming apparatus. Further, the cleaning member is not exposed to the outside of the image forming apparatus, and therefore the outside dust is not attached to the cleaning member 69. Accordingly, when the cover is closed, it is not likely that the dust contaminates the inside of the image forming apparatus or that the foreign material moves to contaminate the exposure device 60.

Embodiment 2

In Embodiment 2, an electrical discharging member 200 is disposed in addition to the cleaning member 69 at a different position from the cleaning member 69 in the retraction path R of the exposure device 60.

Figure 15:
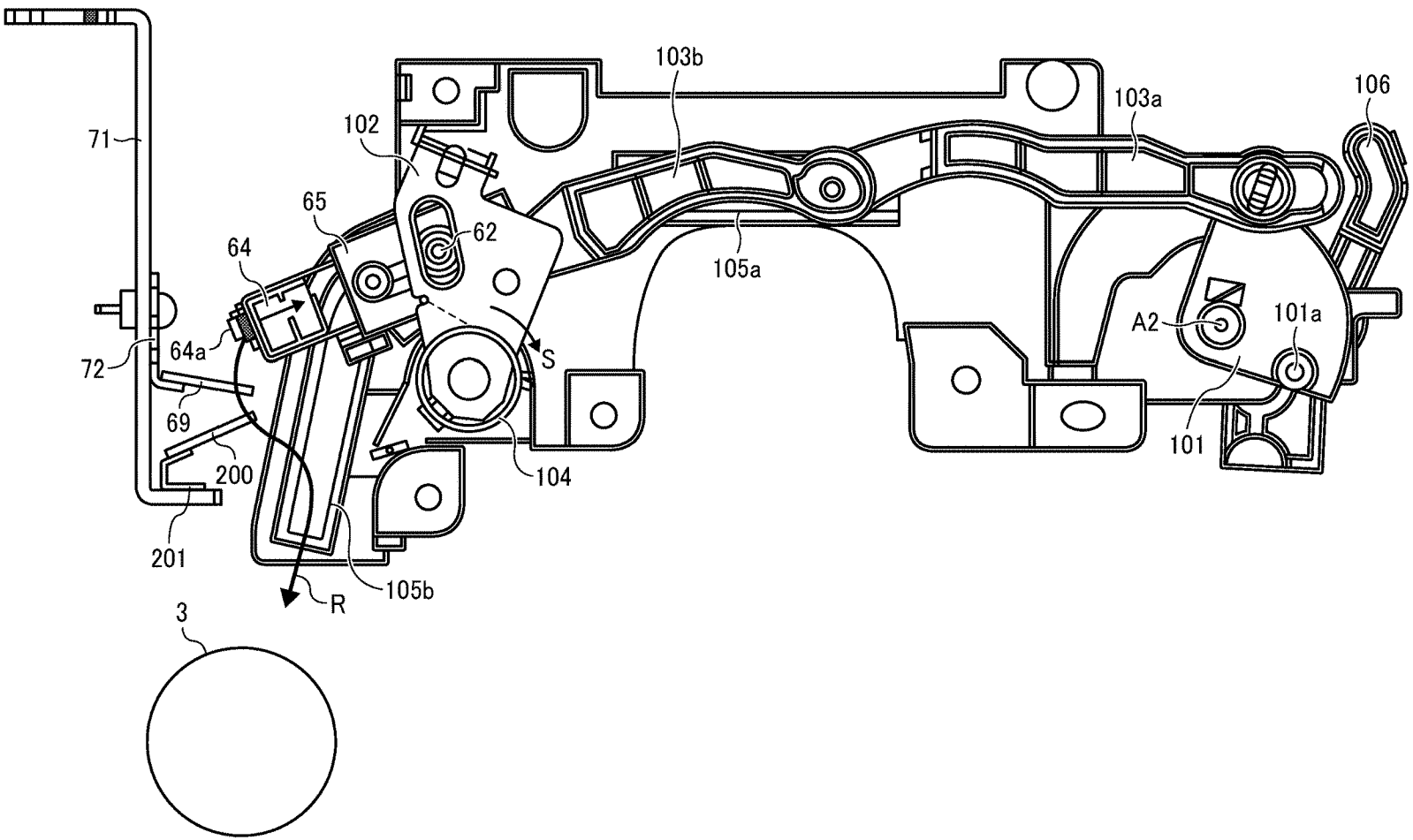
FIG. 15 is a diagram illustrating a configuration in which an electrical discharging member is disposed in addition to the cleaning member to clean the lens surface on the retraction path of the exposure device.

FIG. 15 is a diagram illustrating a configuration in which the electrical discharging member 200 is disposed in addition to the cleaning member 69 to clean the lens surface 64*a* on the retraction path of the exposure device 60.

As illustrated in FIG. 15, by disposing the cleaning member 69 having elasticity at a position in the middle of the curved trajectory of the retraction path R, when the exposure device 60 moves from the retracted position to the exposure position, the lens surface 64*a* of the exposure device 60 is pressed against the cleaning member 69. By so doing, foreign material such as toner and dust is moved from the lens surface 64*a* of the exposure device 60 to the cleaning member 69. Accordingly, the foreign material on the lens surface 64*a* can be removed.

Figure 16:
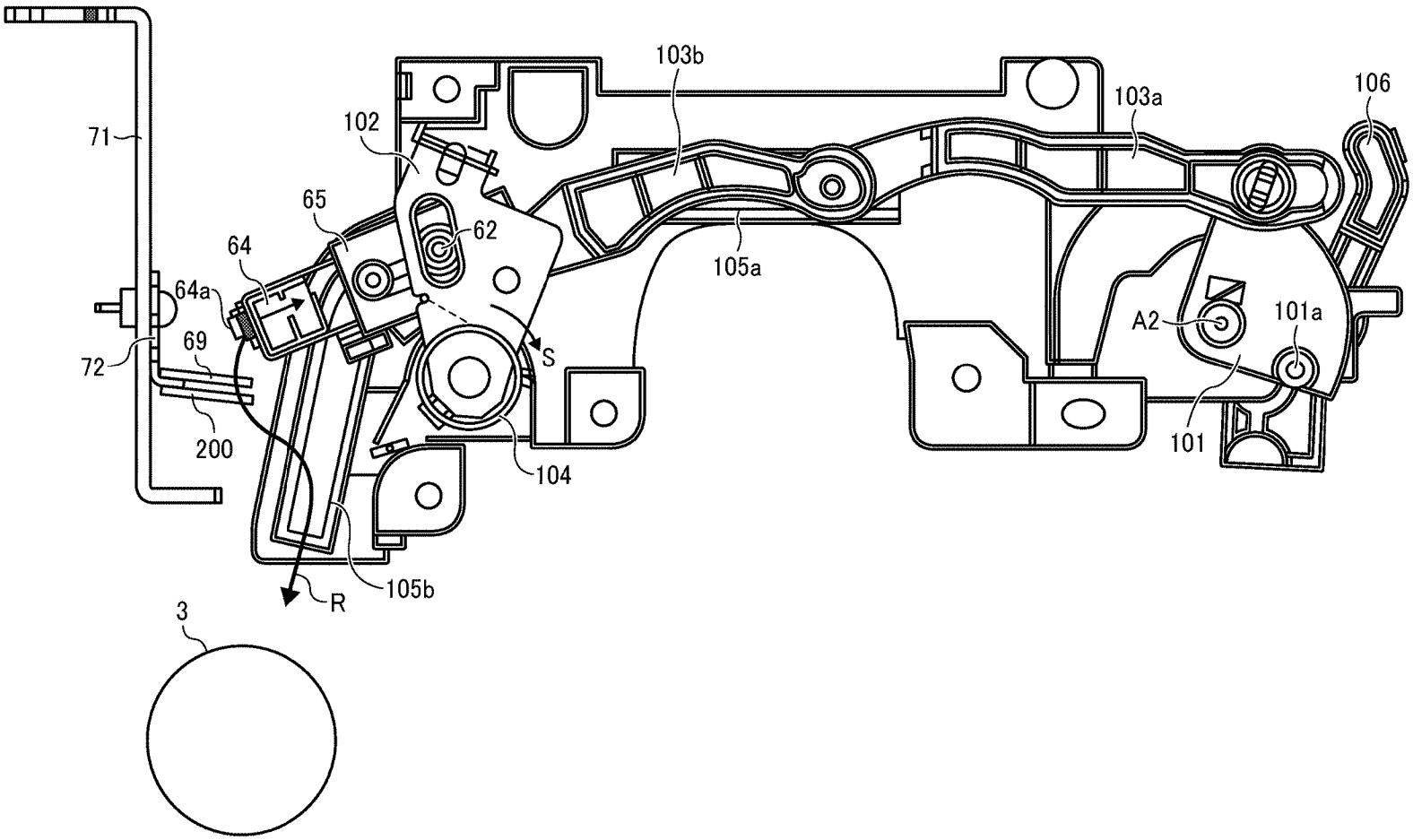
FIG. 16 is a diagram illustrating a configuration in which the cleaning member and the electrical discharging member are disposed on the same holding member on the retraction path of the exposure device.

The cleaning member 69 is a flexibly bendable member, for example, a non-woven cloth attached to a thin mylar or a brush. Alternatively, a member including a sponge seal member can be replaced with the above-described members. The cleaning member 69 is fixed to the holding member 72 with a double sided tape. As illustrated in FIG. 16, the holding member 72 is an L-shaped member fixed to the apparatus body stay 71, for example, with screws.

Further, an electrical discharging member holding member 201 is disposed in addition to the electrical discharging member 200 in the retraction path R of the exposure device 60. Similar to the cleaning member 69, the electrical discharging member 200 is an elastic member and is disposed at a position at which the lens surface 64*a* contacts the electrical discharging member 200 when the exposure device 60 moves along the retraction path R.

The material of the cleaning member 69 and the material of the exposure device 60 or the lens surface 64*a* of the exposure device 60 are in different ranks in the triboelectric series. Therefore, when the cleaning member 69 contacts to clean the lens surface 64*a* of the exposure device 60, at least the charging operation is performed. The lens surface 64*a* is cleaned and charged by the cleaning member 69 simultaneously. Therefore, it is likely that the lens surface 64*a* electrically attracts floating material such as debris and dust floating in the inside of the image forming apparatus. In a case in which the exposure device 60 electrically exposes the photoconductor drum 3 with the floating material attached to the lens surface 64*a*, image density nonuniformity or streaks appear on an image, and therefore the image quality deteriorates.

In order to prevent such deterioration in image quality due to the above-described poor charging, the configuration according to Embodiment 2 further employs the electrical discharging member 200. By disposing the electrical discharging member 200, the electric charge on the exposure device 60 and the lens surface 64*a* charged when the exposure device 60 and the lens surface 64*a* contact the cleaning member 69 is neutralized by the electrical discharging member 200, and therefore the charging state is relaxed. Accordingly, an exposing operation is performed without attracting any floating material to the lens surface 64*a*, and therefore high-quality images can be obtained permanently.

Figure 17:
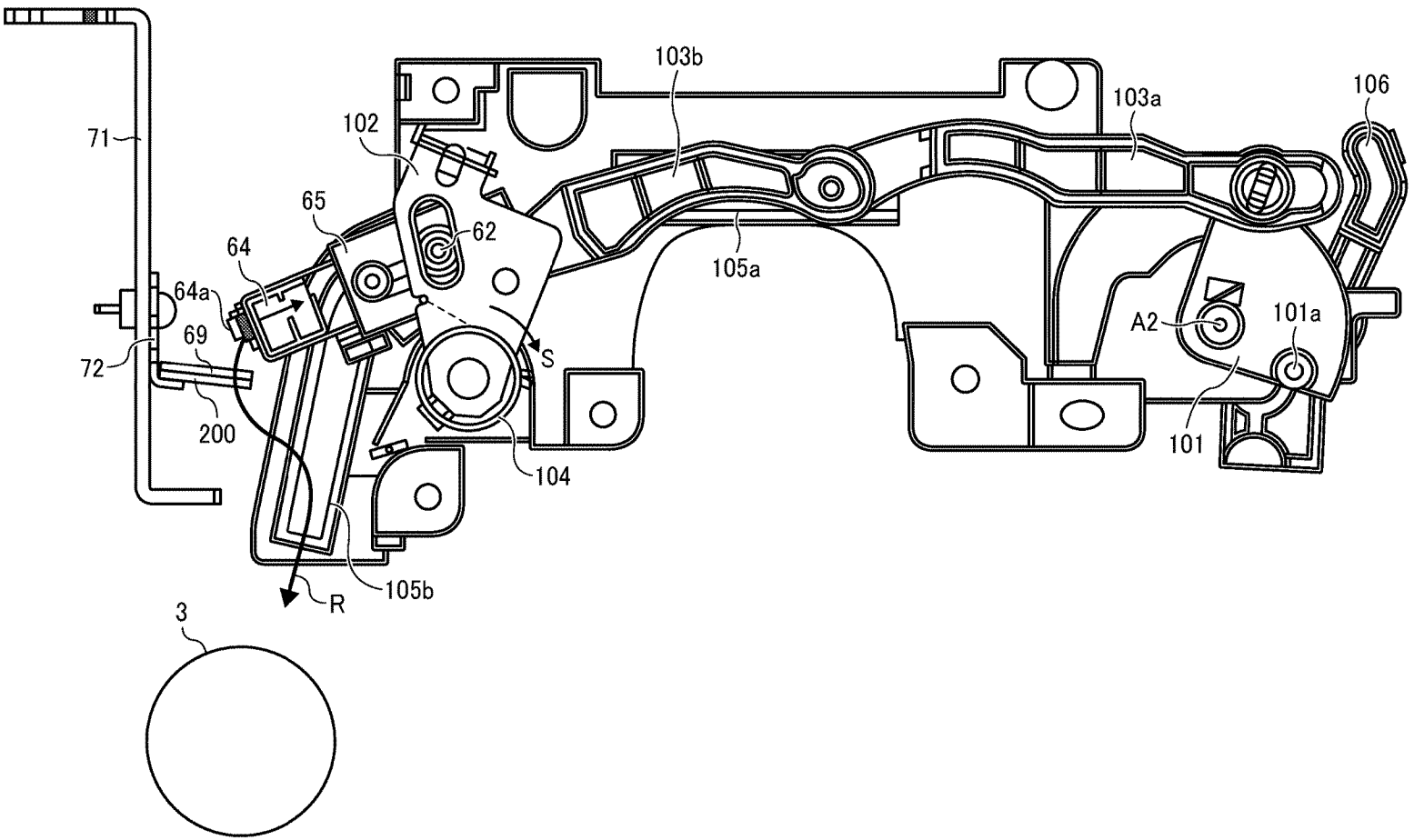
FIG. 17 is a diagram illustrating a configuration in which the electrical discharging member is directly attached to the cleaning member and the holding member holds both the cleaning member and the electrical discharging member.

FIG. 16 is a diagram illustrating a configuration in which the cleaning member 69 and the electrical discharging member 200 are disposed on the same holding member 72 on the retraction path R of the exposure device 60. FIG. 17 is a diagram illustrating a configuration in which the electrical discharging member 200 is directly attached to the cleaning member 69 and the holding member 72 holds both the cleaning member 69 and the electrical discharging member 200.

As illustrated in FIG. 16, the electrical discharging member 200 is held by the holding member 72 that holds the cleaning member 69. According to this configuration, when the exposure device 60 moves from the retracted position to the exposure position, the lens surface 64*a* contacts the electrical discharging member 200 to be electrically discharged immediately after the cleaning member 69 has contacted and cleaned the lens surface 64*a* of the exposure device 60. Accordingly, a ratio of attraction of floating materials to the lens surface 64*a* decreases, and therefore the exposing operation is performed in an ideal state, so that high-quality images can be formed. Further, the number of parts and the number of manpower for assembly can be reduced, and therefore a reduction in costs of parts and assembly can be achieved.

Further, even the configuration illustrated in FIG. 17, in which the electrical discharging member 200 is directly attached to the cleaning member 69 can achieve the same effect as the configuration in FIG. 16.

By repeatedly contacting the cleaning member 69, electric charges accumulate, and therefore the exposure device 60 and the lens surface 64*a* of the exposure device 60 are charged with higher electricity. However, by contacting the electrical discharging member 200 disposed in the retraction path R, the electric charges are discharged from the exposure device 60 and the lens surface 64*a*, and the amount of electric charge of the exposure device 60 and the lens surface 64*a* can be reduced. Respective positions of the cleaning member 69 and the electrical discharging member 200 can be freely selected due to the designing depending on individually expected layouts. For example, as illustrated in FIGS. 15, 16, and 17, the cleaning member 69 and the electrical discharging member 200 are disposed such that the exposure device 60 is cleaned by the cleaning member 69 before contacting the electrical discharging member 200 while the exposure device 60 is moving toward an optical writing position (the exposure position) of the photoconductor drum 3 in the retraction path R. By so doing, the exposure device 60 and the lens surface 64*a* can obtain the smallest amount of electric charges, and therefore adhesion of debris and dust to the exposure device 60 and the lens surface 64*a* thereof can be further restrained.

Figure 18:
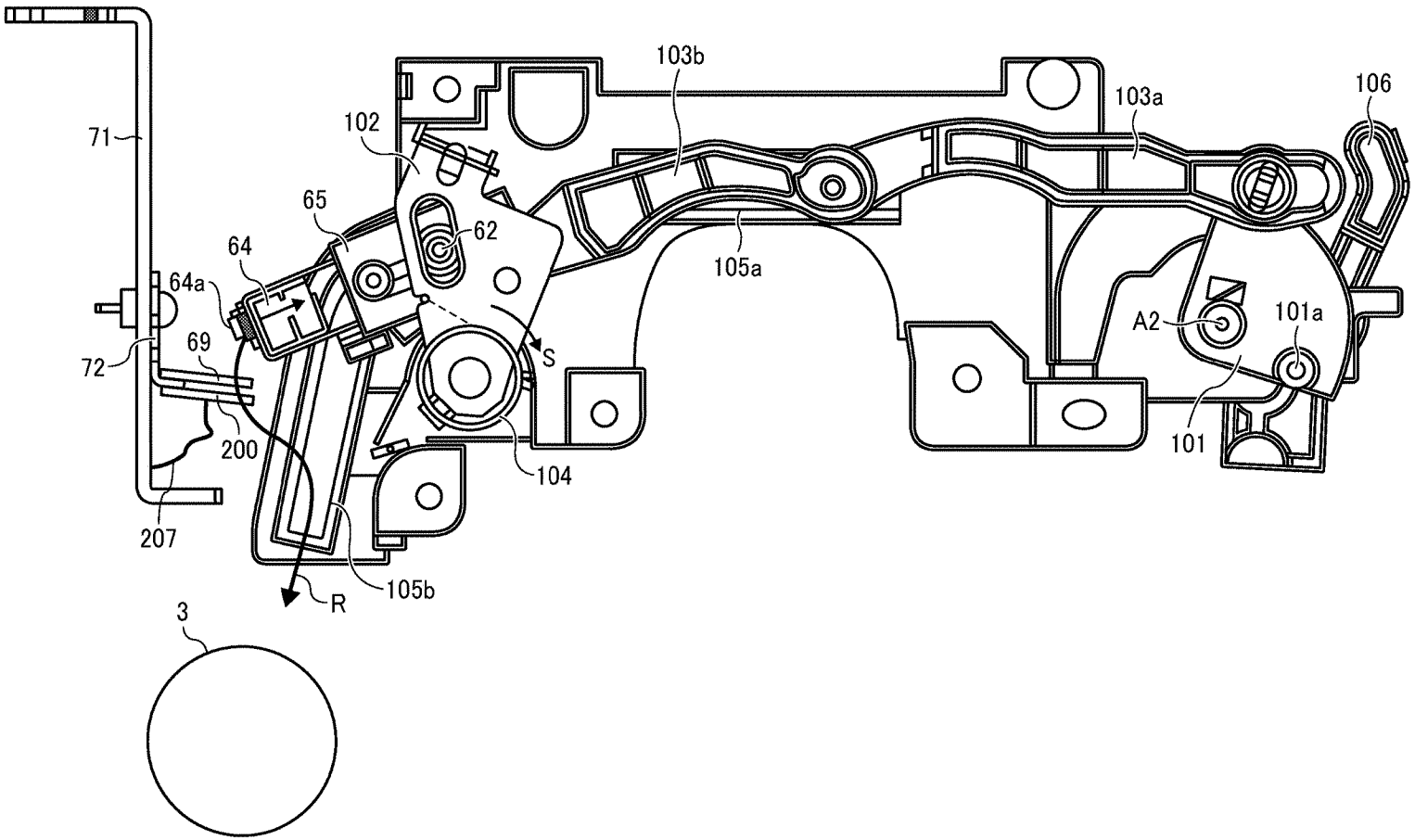
FIG. 18 is a diagram illustrating a configuration in which the electrical discharging member is grounded to an apparatus body of the image forming apparatus via a cable.
Figure 19:
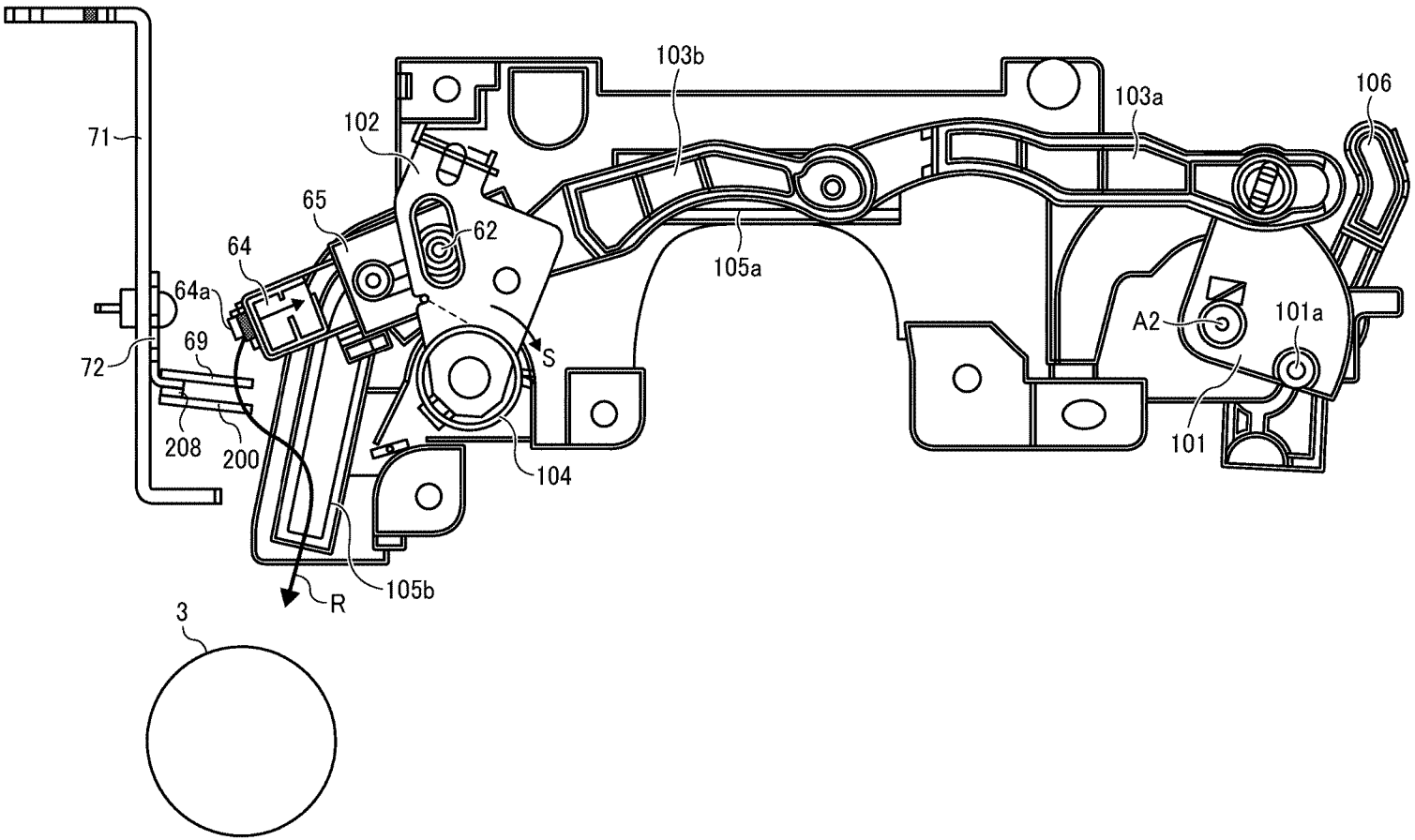
FIG. 19 is a diagram illustrating a configuration in which the electrical discharging member is electrically grounded to the apparatus body of the image forming apparatus via a holding member including a conductive material.

FIG. 18 is a diagram illustrating a configuration in which the electrical discharging member 200 is grounded to the apparatus body 30 of the image forming apparatus 1 via a cable 207. FIG. 19 is a diagram illustrating a configuration in which the electrical discharging member 200 is electrically grounded to the apparatus body 30 of the image forming apparatus 1 via the holding member 72 including a conductive material.

As illustrated in FIG. 18, the electrical discharging member 200 that is held by the holding member 72 is coupled to the apparatus body stay 71 that includes a conductive material such as a sheet metal, via the cable 207. Since the apparatus body stay 71 is electrically grounded to the apparatus body 30, the electrical discharging member 200 is also electrically grounded to the apparatus body 30 via the cable 207 and the apparatus body stay 71.

Further, as illustrated in FIG. 19, the electrical discharging member 200 is attached to the holding member 72 including a conductive material, with the double sided tape. Since a conductive double sided tape 208 is employed as a double sided tape, the electrical discharging member 200 is electrically grounded to the holding member 72. Further, the holding member 72 is electrically grounded with screw to the apparatus body stay 71 including a conductive material, and eventually is electrically grounded to the apparatus body 30.

The electrical discharging member 200 receives electric charges from the exposure device 60 each time the electrical discharging member 200 contacts the charged exposure device 60 or the charged lens surface 64*a*. Therefore, the amount of electrical charges of the electrical discharging member 200 increases. Accordingly, an electrical discharging performance of the electrical discharging member 200 gradually deteriorates.

In Embodiment 2, according to the configurations illustrated in FIGS. 18 and 19, the electrical discharging member 200 is electrically grounded to the apparatus body 30. Consequently, the electric charges accumulated in the electrical discharging member 200 are discharged. Accordingly, an increase in amount of electrical charges of the electrical discharging member 200 can be prevented, and therefore deterioration of the electrical discharging performance can be restrained. By so doing, the electrical discharging member 200 can remove the electrical charges of the exposure device 60 and the lens surface 64*a* thereof constantly and efficiently. Accordingly, the lens surface 64*a* can prevent adhesion of debris and duct thereto, and therefore high-quality images can be obtained.

Further, the electrical discharging member 200 is disposed to mainly remove the electrical charges from the lens surface 64*a*. Therefore, in order to electrically discharge the charges over the entire area of the lens surface 64*a*, the electrical discharging member 200 preferably extends by a length at least equal to or longer than the length of the lens surface 64*a* in the longitudinal direction.

Further, since the electrical discharging member 200 directly contacts the lens surface 64*a*, the electrical discharging member 200 preferably employs a material having a hardness smaller than the lens surface 64*a* so as not to damage the lens surface 64*a*.

Figure 20:
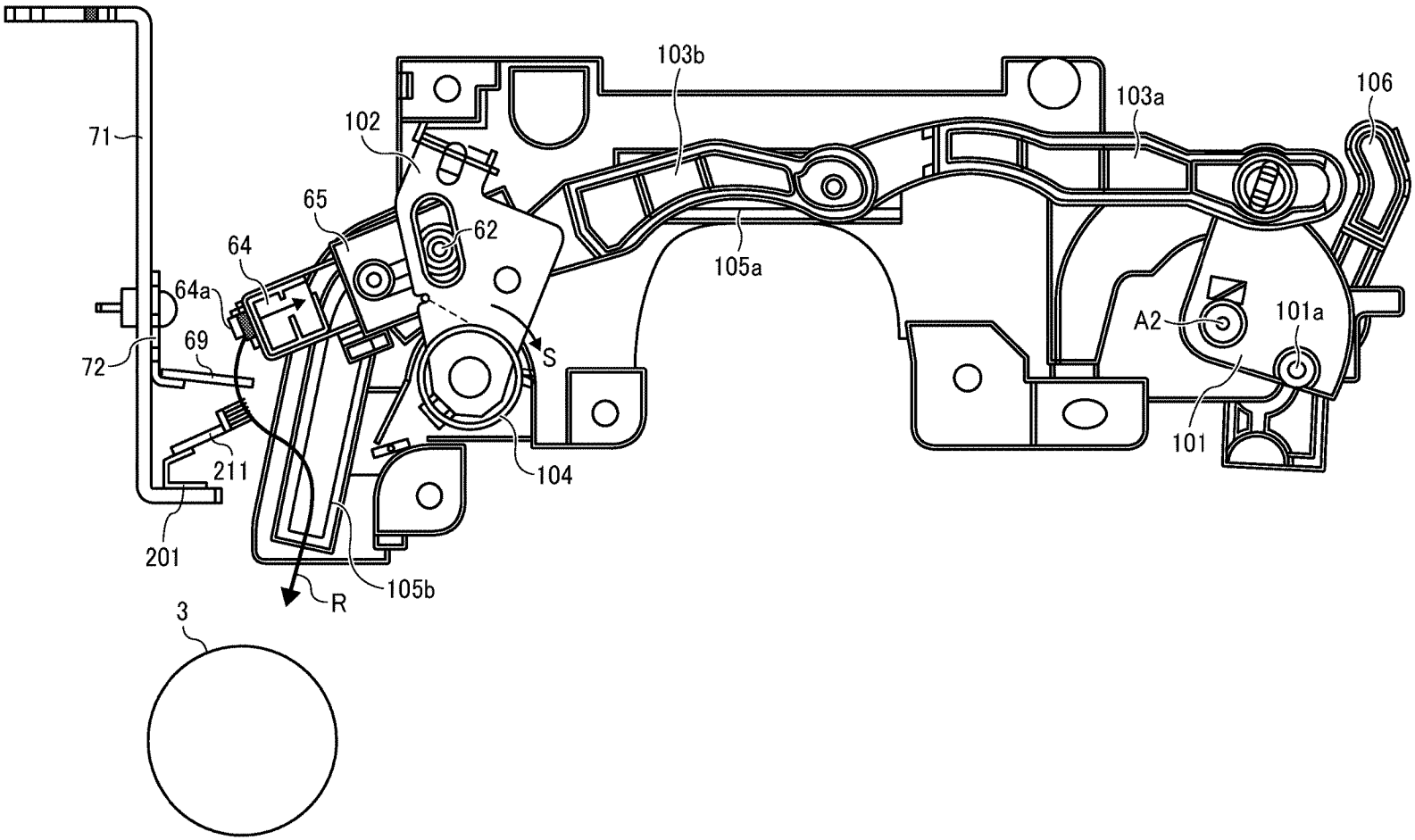
FIG. 20 is a diagram illustrating an example of the retracting unit including an electrical discharging member having a flocking shape.

FIG. 20 is a diagram illustrating an example of the retracting unit 100 including an electrical discharging member 211 having a flocking shape.

As illustrated in FIG. 20, the electrical discharging member 211 having a flocking shape is held by the conductive electrical discharging member holding member 201 that is held by the apparatus body stay 71. As described above, the flocking portion of the electrical discharging member 211 is eventually grounded electrically to the apparatus body 30. According to this configuration, the high electrical discharging performance can be maintained.

By forming the electrical discharging member 211 with the flocking shape, the electrical discharging member 211 can contact the entire area of the exposure device 60 and the entire area of the lens surface 64*a* reliably. Further, the touch of the electrical discharging member 211 to the exposure device 60 and the lens surface 64*a* is softer, and therefore the operation force applied to the movement of opening and closing of the cover 91 can be reduced. Further, the flocking density and thickness of the electrical discharging member 211 can be selected optionally. Accordingly, desired electrical discharging performance and contact pressure can be obtained.

Similar to Embodiment 1, in the configuration of Embodiment 2, the lens surface 64*a* of the exposure device 60 is pressed against the cleaning member 69 while the exposure device 60 is moving along the curved trajectory of the retraction path R. Regarding the case in which the lens surface 64*a* is pressed against the cleaning member 69 while the exposure device 60 is moving the straight line trajectory, the same effect as the configuration of FIGS. 13 and 14 in Embodiment 1 can be achieved. Accordingly, the detailed description is omitted here.

Further, the configuration in Embodiment 2, in which the lens surface 64*a* is pressed against the cleaning member 69 while the exposure device 60 is moving along the curved trajectory, is same as the configuration that employs the electrical discharging member 200 and the configuration that employs the electrical discharging member 211, and therefore the electrical discharging performance can be enhanced.

As described above, the retraction movement of the exposure device 60 is linked to an opening movement of the cover 91. When the cover 91 is closed, the exposure device 60 is set to a predetermined photoconductor neighboring position (the exposure position). By opening and closing of the cover 91, even when any outside debris or dust enter in the image forming apparatus 1, the lens surface 64*a* can be cleaned and electrically discharged reliably, thereby obtaining high quality images.

It is to be noted that any actuator such as a motor and a solenoid can be disposed at a link portion of the exposure device 60. With this configuration, retraction of the exposure device 60 to the retracted position and placing at the exposure position can be conducted by the power. The action timing can be determined optionally. For example, by performing the operation at the power on of the image forming apparatus, debris or dust accidentally adhered to the lens surface 64*a* can be removed and electrically discharged, thereby maintaining good image quality.

Embodiment 3

In Embodiment 3, the cleaning member 69 includes a conductive material.

Figure 21:
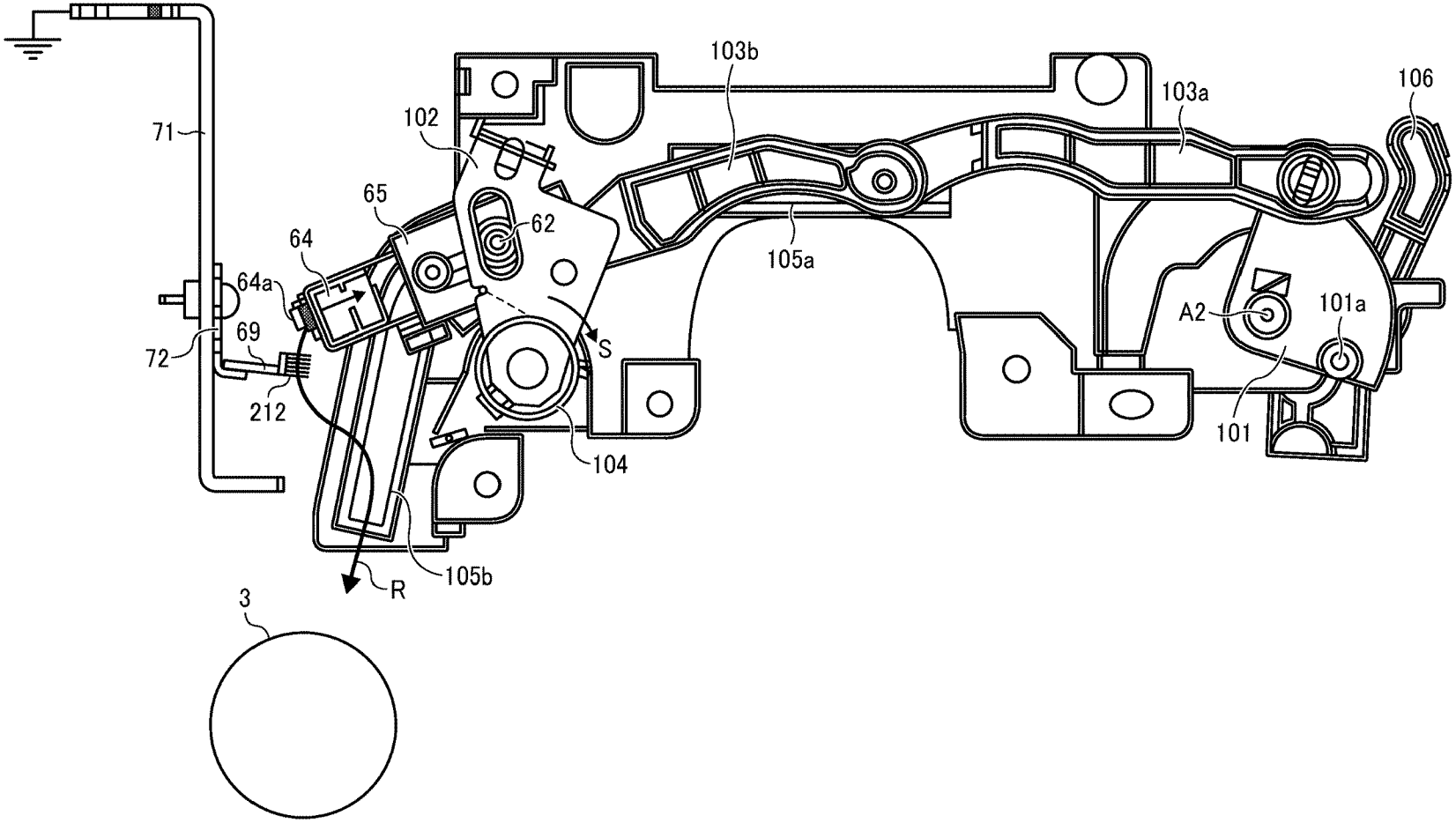
FIG. 21 is a diagram illustrating a configuration in which the retracting unit in which a cleaning member including a conductive material on the retraction path of the exposure device.

FIG. 21 is a diagram illustrating a configuration in which the retracting unit 100 in which the cleaning member 69 including a conductive material on the retraction path R of the exposure device 60.

As illustrated in FIG. 15, by disposing the cleaning member 69 having elasticity on the curved trajectory of the retraction path R, when the exposure device 60 moves from the retracted position to the exposure position, the lens surface 64*a* of the exposure device 60 is pressed against the cleaning member 69. By so doing, foreign material such as toner and dust is moved from the lens surface 64*a* of the exposure device 60 to the cleaning member 69. Accordingly, the foreign material on the lens surface 64*a* can be removed.

The cleaning member 69 according to Embodiment 3 includes a conductive material having a surface resistance value of $10^{13}\Omega$ or smaller. Therefore, the electric charges generated by friction of the lens surface 64*a* and the cleaning member 69 are distributed in the air. Consequently, the charged state of the cleaning member 69 is relaxed.

An example of the cleaning member 69 employed in the configuration of Embodiment 3 includes elasticity, for example, a thin conductive film and a film coated by a material that lowers the surface resistance value. Further, as illustrated in FIG. 21, the cleaning member 69 may include a brush 212 including multiple synthetic fibers such as metallic fibers and conductive fibers. The cleaning member 69 is fixed to the L-shaped holding member 72 including a conductive material (for example, a steel plate) with a conductive double sided tape. The holding member 72 having conductivity is fixed to the apparatus body stay 71 with a conductive material (for example, a steel plate) with screws.

In order to distribute the electric charges generated by friction between the lens surface 64*a* of the exposure device 60 and the cleaning member 69 more reliably, the cleaning member 69 is electrically grounded to the apparatus body 30 via the apparatus body stay 71 that includes a conductive material.

Figure 22A:
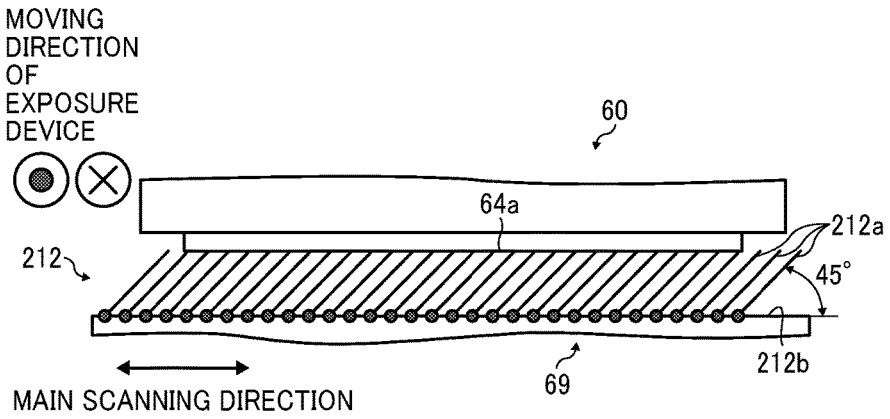
FIGS. 22A and 22B are diagrams illustrating multiple brush fibers of a brush of the cleaning member.
Figure 22B:
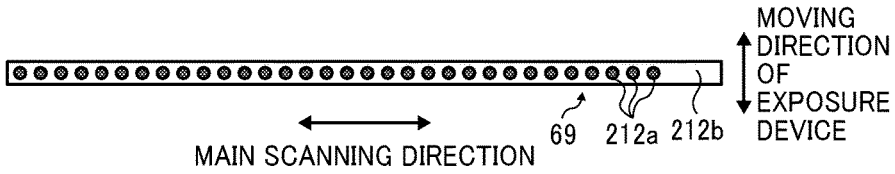

FIGS. 22A and 22B are diagrams illustrating multiple brush fibers 212*a* of a brush 212 of the cleaning member 69. Specifically, FIG. 22A is a diagram illustrating the multiple brush fibers 212.*a* of the brush 212 of the cleaning member 69 viewed from an upstream direction of the exposure device 60 in the moving direction of the exposure device 60. FIG. 22B is a diagram illustrating the multiple brush fibers 212*a* of the brush 212 of the cleaning member 69 viewed from a direction perpendicular to a fiber fixing face 212*b* to which the multiple brush fibers 212*a* are fixed.

As illustrated in FIGS. 22A and 22B, the multiple brush fibers 212*a* included in the brush 212 are fixed to the fiber fixing face 212*b* at specified intervals in a main scanning direction of the exposure device 60. Each of the multiple brush fibers 212*a* is fixed to the fiber fixing face 212*b* at a predetermined angle to the fiber fixing face 212*b*. The predetermined angle is an angle of the fiber fixing face 212*b* and the multiple brush fibers 212*a* less than 90 degrees. It is to be noted that, in Embodiment 3, the multiple brush fibers 212*a* are inclined such that the angle of the fiber fixing face 212*b* and the multiple brush fibers 212*a* is set to be approximately 45 degrees.

By tilting and fixing the multiple brush fibers 212*a* to the fiber fixing face 212*b*, when compared with a configuration in which the multiple brush fibers 212*a* to the fiber fixing face 212*b* are fixed in a direction perpendicular to the fiber fixing face 212*b*, the length of the multiple brush fibers 212*a* can extend longer in length. Accordingly, when compared with the configuration in which the multiple brush fibers 212*a* are fixed to the fiber fixing face 212*b* in a direction perpendicular to the fiber fixing face 212*b*, a touch of the brush 212 of the cleaning member 69 to the lens surface 64*a* can be softer and the operation force applied to the movement of opening and closing of the cover 91 can be reduced.

Further, the cleaning member 69 may include multiple brushes 212 aligned in the moving direction of the exposure device 60.

Figure 23A:
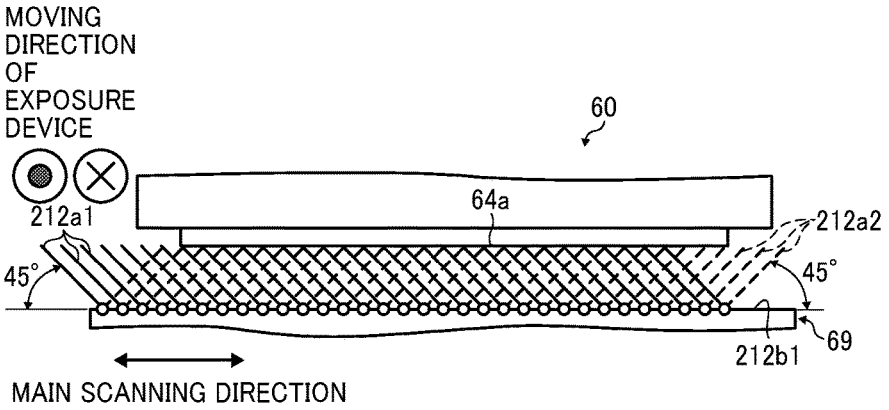
FIGS. 23A and 23B are diagrams illustrating an example of alignment of multiple brushes along a moving direction of the exposure device.
Figure 23B:
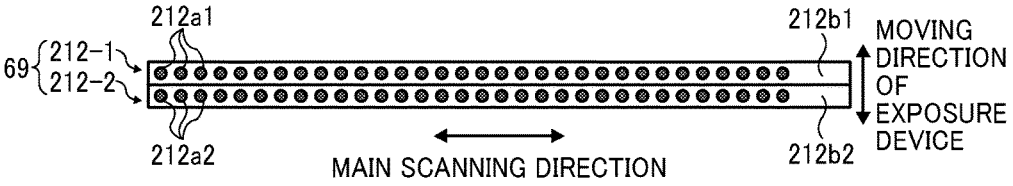

FIGS. 23A and 23B are diagrams illustrating an example of alignment of the multiple brushes 212 along the moving direction of the exposure device 60. Specifically, FIG. 23A is a diagram of the cleaning member 69 viewed from the upstream direction of the exposure device 60 in the moving direction of the exposure device 60. FIG. 23B is a diagram of the cleaning member 69 viewed from a direction perpendicular to the fiber fixing face 212*b*. It is to be noted that a broken line in FIG. 23A is the multiple brush fibers 212*a* aligned on a downstream side in the moving direction of the exposure device 60.

The cleaning member 69 illustrated in FIGS. 23A and 23B includes two brushes 212 disposed overlapped in the moving direction of the exposure device 60. Specifically, the two brushes 212 of the cleaning member 69 of FIGS. 23A and 23B are a first brush 212-1 having first brush fibers 212*a*1 (indicated by solid lines in FIG. 23A) and a second brush 212-2 having second brush fibers 212*a*2 (indicated by broken lines in FIG. 23A). A direction of inclination of the first brush fibers 212*a*1 and a direction of inclination of the second brush fibers 212*a*2 are different from each other. In this configuration of the cleaning member 69 illustrated in FIGS. 23A and 23B, the first brush fibers 212*a*1 are tilted by an angle of 45 degrees to a direction perpendicular to a first fiber fixing face 212*b*1 toward the right side of the drawings and the second brush fibers 212*a*2 are tilted by an angle of 45 degrees to a direction perpendicular to a second fiber fixing face 212*b*2 toward the left side of the drawings.

As illustrated in FIGS. 23A and 23B, the multiple brushes 212, i.e., the first brush 212-1 and the second brush 212-2 are disposed in the moving direction of the exposure device 60 and the brush fibers, i.e., the first brush fibers 212*a*1 and the second brush fibers 212*a*2 are tilted in the directions different from each other. By so doing, when compared with the configuration in which a single brush, i.e., the brush 212 is disposed as illustrated in FIGS. 22A and 22B, the configuration in which the first brush 212-1 and the second brush 212-2 as illustrated in FIGS. 23A and 23B can reduce deterioration of quality in the cleaning performance of the brush 212 due to aging. Specifically, in the configuration illustrated in FIGS. 22A and 22B, the brush fibers 212*a* further incline in a clockwise in the drawings due to aging. As a result, the lens surface 64*a* on the left side end in FIGS. 22A and 22B is not likely to contact the brush fibers 212*a*.

Accordingly, foreign materials on the lens surface 64*a* on the left side end in FIGS. 22A and 22B are not likely to be removed.

By contrast, in the configuration illustrated in FIGS. 23A and 23B, the first brush fibers 212*a*1 (indicated by solid lines in the drawings) further incline in a counterclockwise in the drawings due to aging and the second brush fibers 212*a*2 (indicated by broken lines in the drawings) further incline in a clockwise in the drawings due to aging. According to this configuration, even though the first brush fibers 212*a*1 bend in the counterclockwise direction in the drawings due to aging, the second brush fibers 212*a*2 bend in the clockwise direction due to aging, so that the second brush fibers 212*a*2 contacts the right side end of the lens surface 64*a* in the drawings. Accordingly, the foreign materials on the right side end of the lens surface 64*a* can be removes reliably. Similarly, even though the second brush fibers 212*a*2 (indicated by the broken lines in the drawings) bend in the clockwise in the drawings due to aging, the first brush fibers 212*a*1 (indicated by the solid lines in the drawings) bend in the clockwise in the drawings due to aging, so that the first brush fibers 212*a*1 contacts the left side end of the lens surface 64*a* in the drawings. Consequently, the foreign materials on the left side end of the lens surface 64*a* can be removes reliably. Accordingly, the cleaning member 69 illustrated in FIGS. 23A and 23B can remove foreign materials reliably even though the time passes.

Figure 24A:
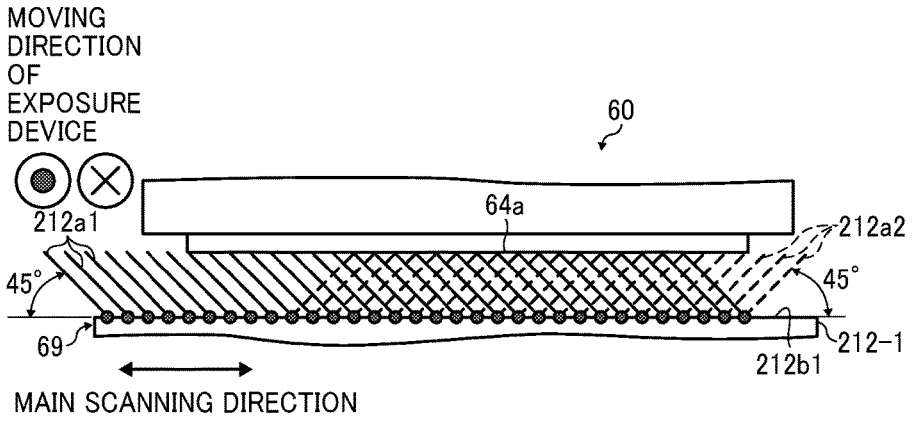
FIGS. 24A and 24B are diagrams illustrating another example of alignment of the multiple brushes according to a variation of FIG. 23.
Figure 24B:
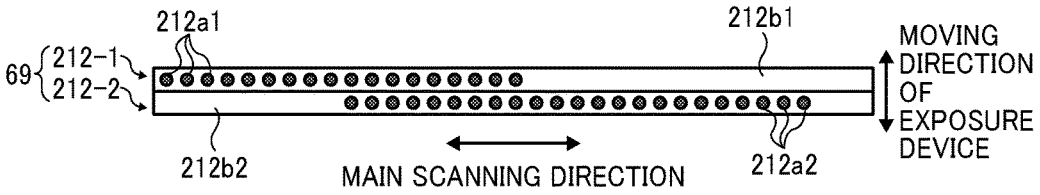

FIGS. 24A and 24B are diagrams illustrating another example of alignment of the multiple brushes 212-1 and 212-2 according to a variation of FIGS. 23A and 23B. Specifically, FIG. 24A is a diagram of the cleaning member 69 viewed from the upstream direction of the exposure device 60 in the moving direction of the exposure device 60. FIG. 24B is a diagram of the cleaning member 69 viewed from a direction perpendicular to the fiber fixing face 212*b*.

The cleaning member 69 illustrated in FIGS. 24A and 24B includes the first brush 212-1 having the first brush fibers 212*a*1 (indicated by solid lines in FIG. 24A) and the second brush 212-2 having the second brush fibers 212*a*2 (indicated by broken lines in FIG. 24A). As illustrated in FIGS. 24A and 24B, in the configuration of this variation, the first brush fibers 212*a*1 and the second brush fibers 212*a*2 are overlapped at the center in the main scanning direction. In FIGS. 24A and 24B, the first brush 212-1 on the upstream side in the moving direction of the exposure device 60 is disposed with the first brush fibers 212*a*1 on the left side in the drawings and the second brush 212-2 on the downstream side in the moving direction of the exposure device 60 is disposed with the second brush fibers 212*a*2 on the right side in the drawings. Further, each of the first brush fibers 212*a*1 and the second brush fibers 212*a*2 is tilted such that the leading end (the free end) thereof is located to the end side of the cleaning member 69 in the main scanning direction than the fixed end (the root end) thereof.

When compared with the configuration of FIGS. 23A and 23B, the configuration of the variation of FIGS. 24A and 24B can reduce the number of brush fibers. Further, when compared with the configuration of FIG. 41, the configuration of the variation of FIGS. 24A and 24B can achieve a reduction in manufacturing cost of the image forming apparatus 1. In addition, even though the brush fibers further incline due to aging, the cleaning member 69 of this variation can remove foreign materials to both ends of the lens surface 64*a* in the main scanning direction of the exposure device 60 reliably.

Figure 25A:
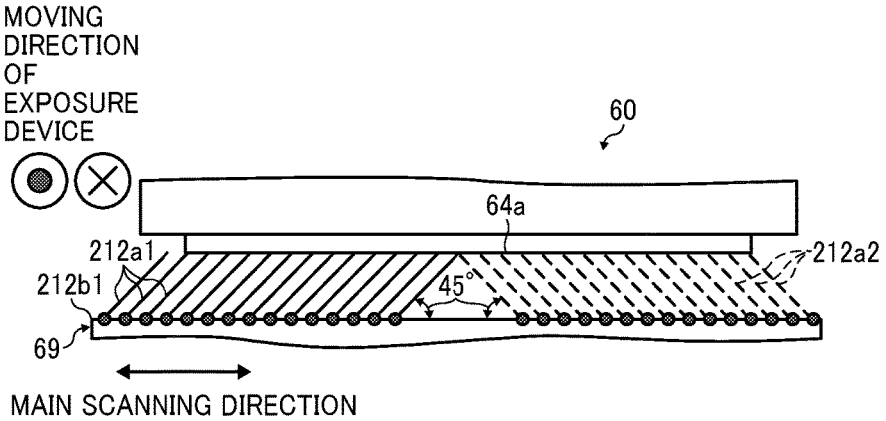
FIGS. 25A and 25B are diagrams illustrating yet another example of alignment of the multiple brushes according to another variation of FIG. 23.
Figure 25B:
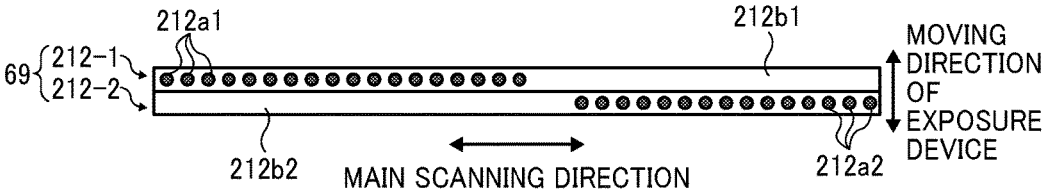

FIGS. 25A and 25B are diagrams illustrating yet another example of alignment of the multiple brushes 212-1 and 212-2 according to another variation of FIGS. 23A and 23B. Specifically, FIG. 25A is a diagram of the cleaning member 69 viewed from the upstream direction of the exposure device 60 in the moving direction of the exposure device 60. FIG. 25B is a diagram of the cleaning member 69 viewed from a direction perpendicular to the fiber fixing face 212*b*.

The cleaning member 69 illustrated in FIGS. 25A and 25B includes the first brush 212-1 having the first brush fibers 212*a*1 (indicated by solid lines in FIG. 25A) and the second brush 212-2 having the second brush fibers 212*a*2 (indicated by broken lines in FIG. 25A). As illustrated in FIGS. 25A and 25B, in the configuration of this variation, the first brush fibers 212*a*1 and the second brush fibers 212*a*2 are tilted such that the leading end (the free end) thereof is located to the center of the cleaning member 69 in the main scanning direction than the fixed end (the root end) thereof. Therefore, the number of brush fibers can be further reduced.

By aligning the first brush fibers 212*a*1 and the second brush fibers 212*a*2 to tilt such that the leading end (the free end) thereof is located to the center of the cleaning member 69 in the main scanning direction than the fixed end (the root end) thereof, brush fibers at the center in the main scanning direction can be eliminated, and therefore the number of brush fibers can be more reduced when compared with the configuration of the cleaning member 69 of FIGS. 23A and 23B and the configuration of the cleaning member 69 of FIGS. 24A and 24B. Accordingly, the configuration of the cleaning member 69 of FIGS. 25A and 25B can achieve a reduction in manufacturing cost of the image forming apparatus 1.

It is to be noted that the configurations of the cleaning member 69 of FIGS. 22A through 25B can be applied to the electrical discharging member 211 illustrated in FIG. 20.

Figure 26:
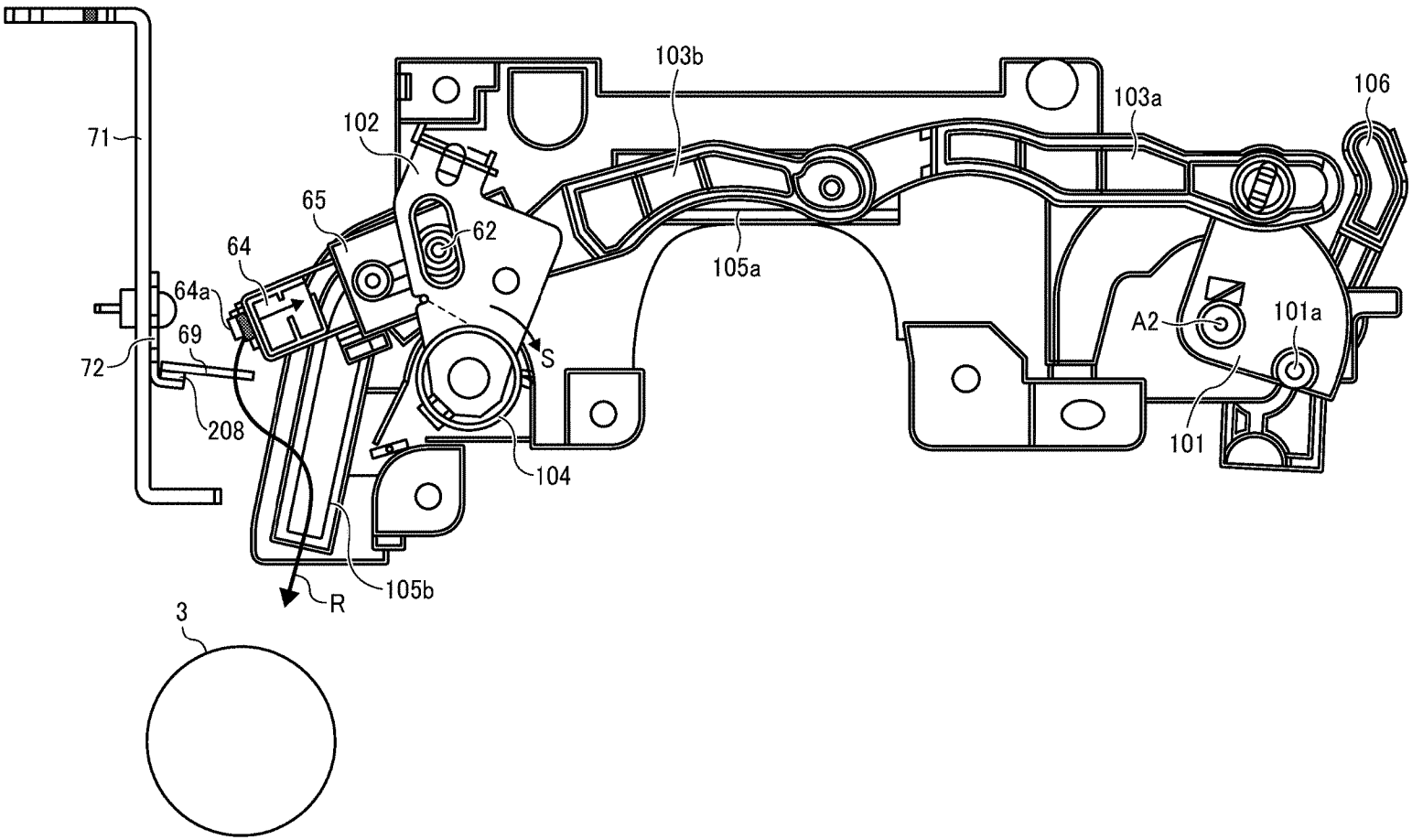
FIG. 26 is a diagram illustrating a configuration of the retracting unit in which the cleaning member is attached to the holding member including a conductive material with a conductive double sided tape.

FIG. 26 is a diagram illustrating a configuration of the retracting unit 100 in which the cleaning member 69 is attached to the holding member 72 including a conductive material with the conductive double sided tape 208.

In the configuration illustrated in FIG. 26, by using the conductive double sided tape 208, the cleaning member 69 is electrically coupled with the holding member 72. Further, the cleaning member 69 is fixed to the apparatus body stay 71 with screws.

Since the cleaning member 69, the holding member 72, and the apparatus body stay 71 are electrically coupled with each other, the electric charges generated by friction of the cleaning member 69 and the lens surface 64*a* are distributed to the cleaning member 69, the holding member 72; and the apparatus body stay 71. Consequently, when compared with a configuration without any electrical connection of the cleaning member 69, the holding member 72, and the apparatus body stay 71, the configuration illustrated in FIG. 26 can reduce the amount of charges per a unit area.

Here, in a case in which the cleaning member 69 includes smaller conductivity, the cleaning member 69 with smaller conductivity and the exposure device 60 or the lens surface 64*a* of the exposure device 60 are in different ranks in the triboelectric series. Therefore, when the cleaning member 69 contacts to clean the lens surface 64*a* of the exposure device 60, at least the charging operation is performed. The lens surface 64*a* is cleaned and charged by the cleaning member 69 simultaneously. Therefore, it is likely that the lens surface 64*a* electrically attracts floating material such as debris and dust floating in the inside of the image forming apparatus 1. In a case in which the exposure device 60 electrically exposes the photoconductor drum 3 with the floating material attached to the lens surface 64*a*, image density nonuniformity or streaks appear on an image, and therefore the image quality deteriorates.

The exposure device 60 according to Embodiment 3 includes a conductive material. Therefore, the electric charges generated by contact of the cleaning member 69 and the exposure device 60 or the lens surface 64*a* of the exposure device 60 are not accumulated in the inside of the image forming apparatus 1 but are distributed in the air. Consequently, the charged state of the cleaning member 69 is relaxed. Accordingly, the exposing operation is performed without attracting any floating material to the lens surface 64*a*, and therefore high-quality images can be obtained permanently. In a case in which the surface resistance value of the cleaning member 69 is $10^{13}\Omega$ or smaller, the electric charges generated by friction are prevented from charge accumulation and are distributed in the air. Consequently, the charged state of the cleaning member 69 is relaxed. Accordingly, the exposing operation is performed without attracting any floating material to the lens surface 64*a*, and therefore high-quality images can be obtained permanently.

By repeatedly contacting the cleaning member 69, the electric charges accumulated in the image forming apparatus 1, and therefore the exposure device 60 and the lens surface 64*a* of the exposure device 60 are charged with higher electricity. However, the cleaning member 69 according to Embodiment 3 includes conductivity and the cleaning member 69, the holding member 72, and the apparatus body stay 71 are electrically connected with each other. By so doing, the electric charges are distributed from the cleaning member 69 to the holding member 72 and the apparatus body stay 71. Therefore, the exposure device 60 and the lens surface 64*a* of the exposure device 60 can obtain the smallest amount of electric charges, and therefore adhesion of debris and dust to the exposure device 60 and the lens surface 64*a* thereof can be further restrained.

Figure 27:
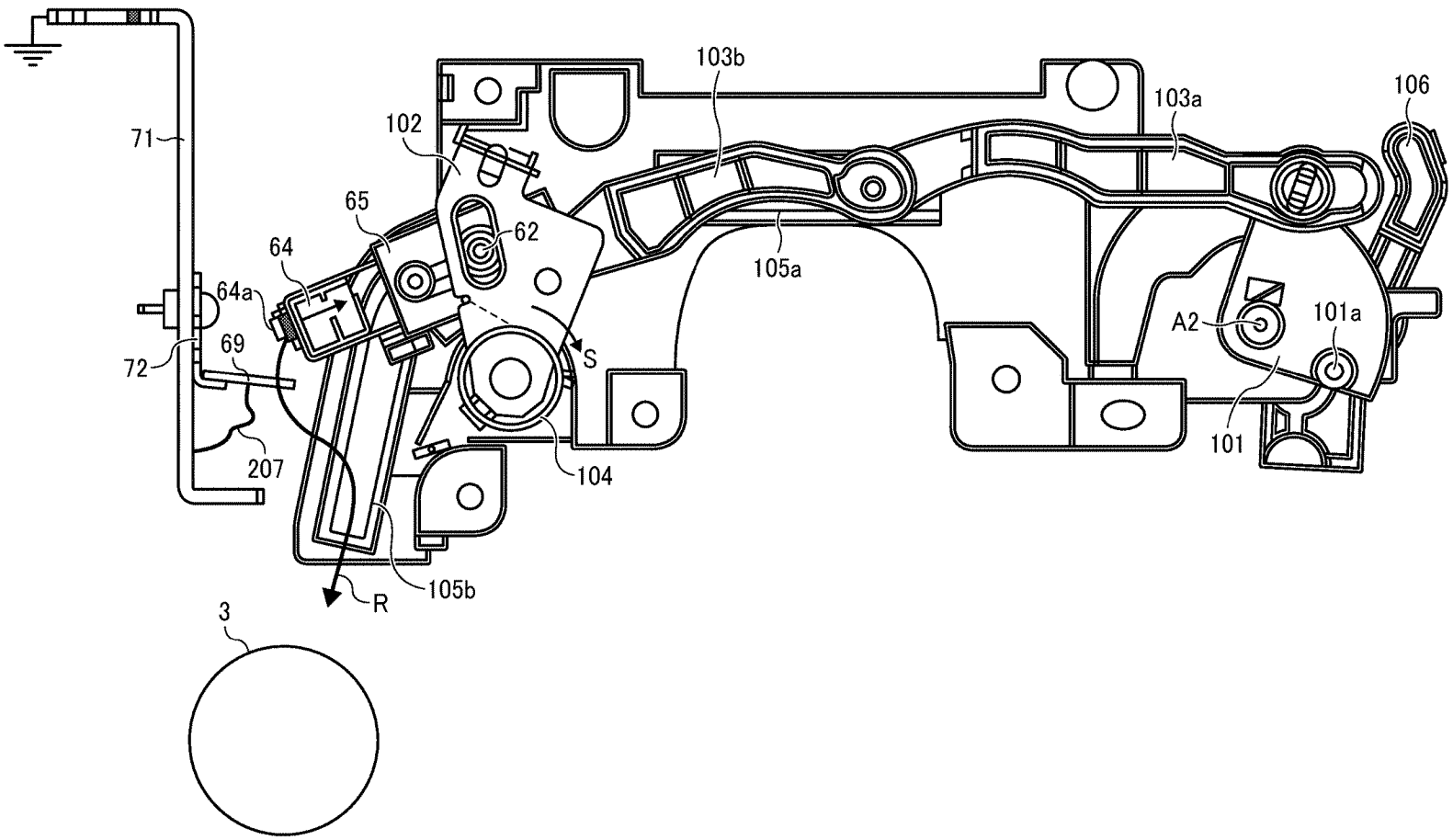
FIG. 27 is a diagram illustrating a configuration of the retracting unit in which the cleaning member is electrically grounded to an apparatus body stay including a conductive material via a cable.

FIG. 27 is a diagram illustrating a configuration of the retracting unit 100 in which the cleaning member 69 is electrically grounded to the apparatus body stay 71 including a conductive material via a cable 207.

In the configuration illustrated in FIG. 27, the apparatus body stay 71 includes a conductive material such as a steel plate. The apparatus body stay 71 is electrically grounded to the apparatus body 30.

Figure 28:
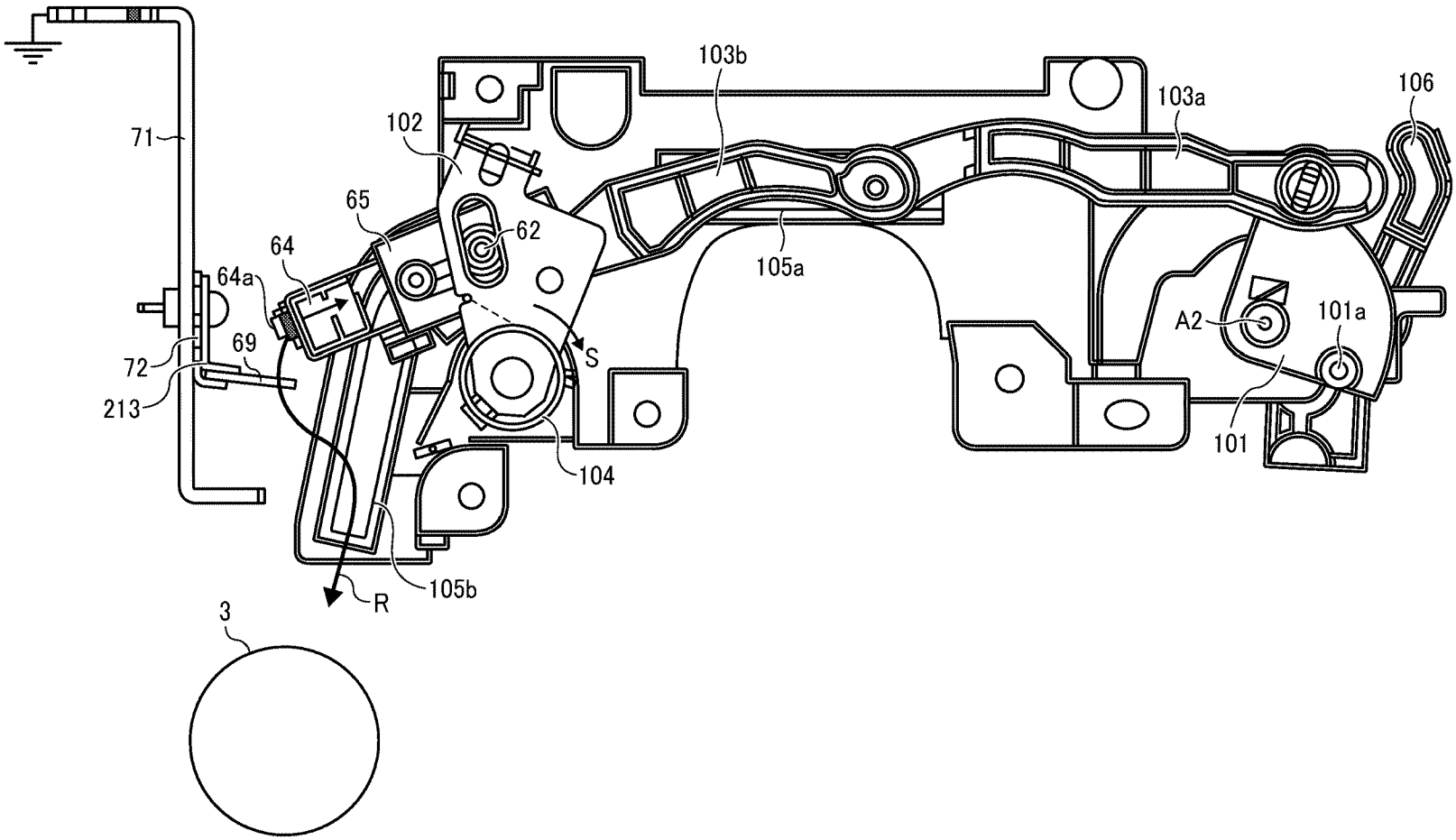
FIG. 28 is a diagram illustrating a configuration of the retracting unit in which the cleaning member contacts the holding member and a leaf spring and is electrically grounded to the apparatus body stay.

FIG. 28 is a diagram illustrating a configuration of the retracting unit 100 in which the cleaning member 69 contacts the holding member 72 and a leaf spring 213 and is electrically grounded to the apparatus body stay 71. As illustrated in FIG. 28, the cleaning member 69 may contact the holding member 72 and the leaf spring 213 and may be electrically grounded to the apparatus body stay 71.

In the configuration of FIG. 28, in order to electrically connect the cleaning member 69, the holding member 72, and the leaf spring 213, the holding member 72 attached to the apparatus body stay 71 and the leaf spring 213 including a SUS material contact the cleaning member 69, and then the cleaning member 69 is electrically grounded to the apparatus body stay 71. The apparatus body stay 71 is electrically grounded to the apparatus body 30.

As described with the configuration illustrated in FIGS. 27 and 28, the cleaning member 69 includes a conductive material and the apparatus body stay 71 to which the cleaning member 69 is attached is electrically grounded to the apparatus body 30. Consequently, the electric charges generated in the cleaning member 69 is transferred from the cleaning member 69 to the apparatus body stay 71. Then, the apparatus body stay 71 that is electrically grounded to the apparatus body 30 does not accumulate the electric charges, and therefore the cleaning member 69 can be prevented from being charged. Accordingly, the exposure device 60 and the lens surface 64*a* of the exposure device 60 can obtain the smallest amount of electric charges, and therefore adhesion of debris and dust to the exposure device 60 and the lens surface 64*a* can be further restrained.

Further, since the exposure device 60 includes a lens array made of glass, the cleaning member 69 may be a nylon sheet or a rayon brush, both of which are ranked relatively close to glass in the triboelectric series (see FIG. 21). Consequently, the electric charges generated by friction can be restrained. By restraining generation of the electric charges, the amount of electric charges are reduced. Accordingly, adhesion of debris and duct to the lens surface 64*a* can be prevented, thereby achieving production of high-quality images.

As described above, the configuration in Embodiment 3 includes the cleaning member 69 that includes a conductive material. However, the electrical discharging member 200 of Embodiment 2 and the electrical discharging member 211 having a flocking shape may be formed by the above-described conductive materials. Accordingly, the more preferable electrical discharging performance of the electrical discharging member 200 and the electrical discharging member 211 having a flocking shape can be maintained.

Embodiment 4

In Embodiment 4, a cleaning member is rotatably supported.

Figure 29:
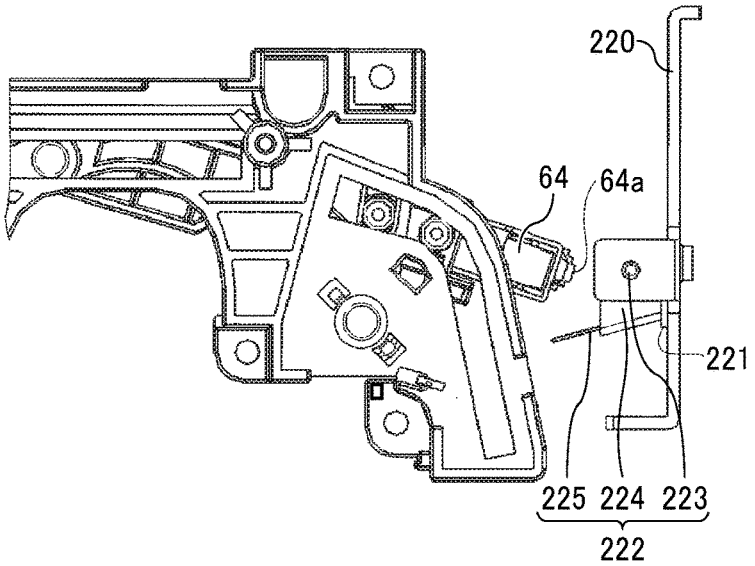
FIG. 29 is a diagram illustrating a configuration of the retracting unit in which a cleaning member that is rotatably supported on the retraction path of the exposure device.
Figure 30:
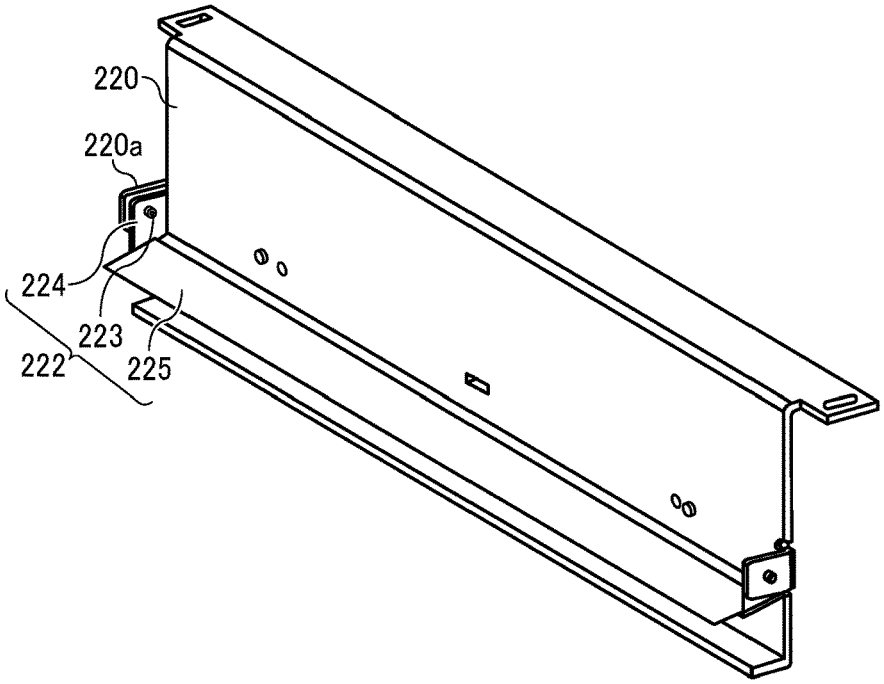
FIG. 30 is a perspective view illustrating the cleaning member that is rotatably supported by the apparatus body stay.

FIG. 29 is a diagram illustrating a configuration of the retracting unit 100 in which a cleaning member 222 that is rotatably supported on the retraction path R of the exposure device 60. FIG. 30 is a perspective view illustrating the cleaning member 222 that is rotatably supported by an apparatus body stay 220.

As illustrated in FIGS. 29 and 30, the cleaning member 222 is rotatably supported by the apparatus body stay 220. The cleaning member 222 includes a shaft 223, a bracket 224, and a cleaning portion 225. The shaft 223 is mounted on both ends of the longitudinal direction of the cleaning member 222 to rotate the cleaning member 222. The bracket 224 holds the shaft 223. The cleaning portion 225 removes and cleans the lens surface 64*a* of the writing head (LED array) 64. The apparatus body stay 220 includes cleaning member holding portions 220*a* at both ends of the longitudinal direction of the apparatus body stay 220. The cleaning member holding portions 220*a* include respective holding holes to rotatably hold the shaft 223 of the cleaning member 222 at both longitudinal ends. In addition, the apparatus body stay 220 includes a rotation regulating member 221 that regulates rotation of the cleaning member 222 (see FIG. 31). The respective holding holes of the cleaning member holding portions 220*a* of the apparatus body stay 220 rotatably hold both longitudinal ends of the shaft 223 of the cleaning member 222. By so doing, the cleaning member 222 can be rotatably held about the shaft 223.

If the cleaning member 222 is formed by a single part, the shape of the cleaning member 222 may be complicated, and therefore it is likely to increase the manufacturing cost of the image forming apparatus 1.

By contrast, the cleaning member 222 in Embodiment 4 includes the above-described three parts. Therefore, when compared with a configuration in which the cleaning member includes a single part, the shape can be formed more easily, and therefore the manufacturing cost can be reduced.

When the cleaning member 222 contacts the rotation regulating member 221 while the writing head 64 of the exposure device 60 is being retracted, it is likely that a large sound occurs and harsh noise is generated depending on the operability of the retraction movement of the writing head 64. Therefore, the rotation regulating member 221 may include a shock absorbing member such as rubber and sponge. Accordingly, the sound of collision that may be generated when the cleaning member 222 contacts the rotation regulating member 221 that includes a shock absorbing member can be reduced.

Figure 31:
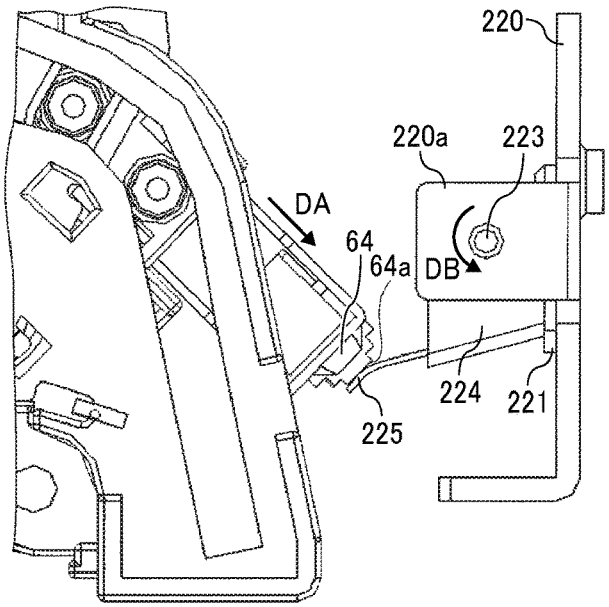
FIG. 31 is a diagram illustrating a state in which a writing head (an LED array) of the exposure device moves from the retracted position to the exposure position.

FIG. 31 is a diagram illustrating a state in which the writing head 64 of the exposure device 60 moves from the retracted position to the exposure position.

As illustrated in FIG. 31, when the writing head 64 moves in a direction indicated by arrow DA in FIG. 31, which functions as a first rotation direction, the lens surface 64*a* contacts the cleaning portion 225 that is located in the middle of the retraction path and the cleaning member 222 tries to rotate about the shaft 223 in a direction indicated by arrow DB in FIG. 31. After the bracket 224 of the cleaning member 222 has contacted the rotation regulating member 221 that is mounted on the apparatus body stay 220, the rotation of the cleaning member 222 is regulated at a predetermined position and a predetermined angle to stop. According to this operation, the cleaning portion 225 can clean the lens surface 64*a* of the writing head 64 with an appropriate force. As the writing head 64 further moves toward the exposure position, the lens surface 64*a* separates from the cleaning portion 225 of the cleaning member 222, and the cleaning operation on the lens surface 64*a* is completed.

Figure 32:
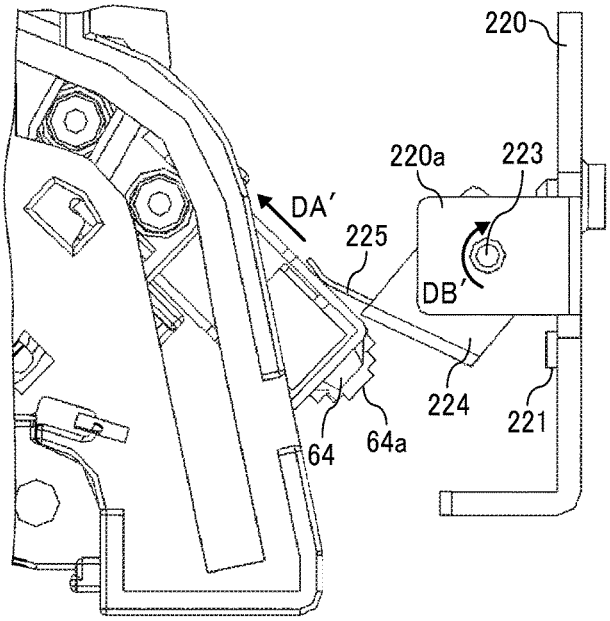
FIG. 32 is a diagram illustrating a state in which the writing head (the LED array) of the exposure device moves from the exposure position to the retracted position.

FIG. 32 is a diagram illustrating a state in which the writing head 64 of the exposure device 60 moves from the exposure position to the retracted position.

As illustrated in FIG. 32, when the writing head 64 moves in a direction indicated by arrow DA' in FIG. 32, which functions as a second rotation direction, the writing head 64 contacts the cleaning portion 225, the writing head 64 contacts the cleaning portion 225, and the cleaning member 222 tries to rotate about the shaft 223 in a direction indicated by arrow DB' in FIG. 32. At this time, since the cleaning member 222 applies a force equal to the own weight of the cleaning member 222 to the writing head 64, the writing head 64 can move to the retracted position sufficiently by a resilience of the torsion spring 104.

According to the above-described configuration and operations of Embodiment 4, the lens surface 64*a* of the writing head 64 can be cleaned by the movement of the writing head 64 of the exposure device 60 from the retracted position to the exposure position with an appropriate force.

By contrast, by making the movement of the writing head 64 from the exposure position to the retracted position, the writing head 64 is not hindered by the cleaning member 222 and can be retracted to the predetermined position reliably.

Figure 33:
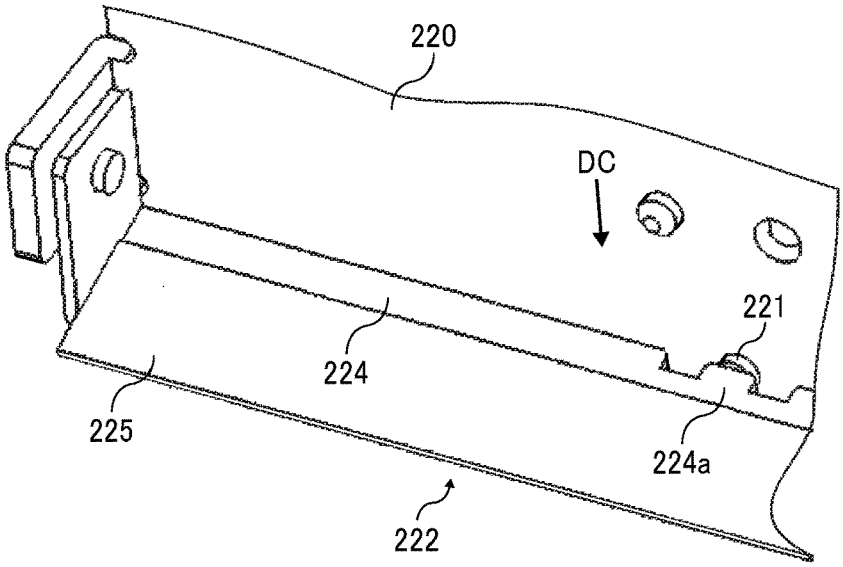
FIG. 33 is a perspective view illustrating rotation regulating members disposed to the cleaning member and the apparatus body stay.
Figure 34:
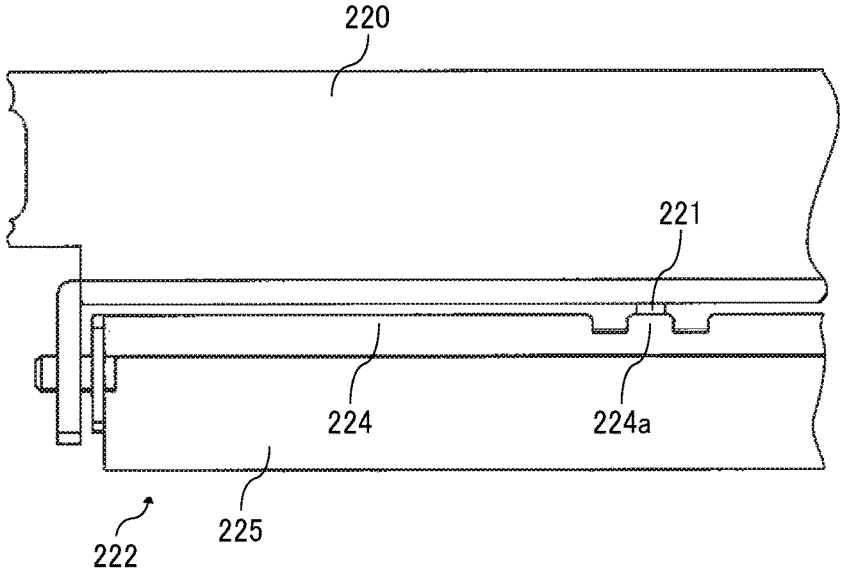
FIG. 34 is a top view illustrating the rotation regulating members, viewed from a direction DC of FIG. 29.

FIG. 33 is a perspective view illustrating rotation regulating members 221 and 224*a* disposed to the cleaning member 222 and the apparatus body stay 220, respectively. FIG. 34 is a top view illustrating the rotation regulating members 221, viewed from a direction DC of FIG. 33.

As illustrated in FIGS. 33 and 34, the rotation regulating member 221 is attached to the apparatus body stay 220 and the rotation regulating member 224*a* is attached to the bracket 224 of the cleaning member 222. By providing the rotation regulating member 221 to the apparatus body stay 220 and the rotation regulating member 224*a* to the bracket 224, the rotation regulating members 221 and 224*a* can have respective dimensional tolerances of high precision. According to this operation, the cleaning member 222 can be regulated at a more precise position, and therefore the cleaning operation on the writing head 64 and the lens surface 64*a* can be performed more appropriately.

In the configurations illustrated in FIGS. 29 through 32, the rotation regulating member 221 is attached to the apparatus body stay 220. However, the effect of this disclosure can also be achieved when a different rotation regulating member is attached to the cleaning member 222. Further, by providing the rotation regulating members at both of the apparatus body stay 220 and the cleaning member 222, the effect can be achieved more appropriately.

Embodiment 5

Figure 35:
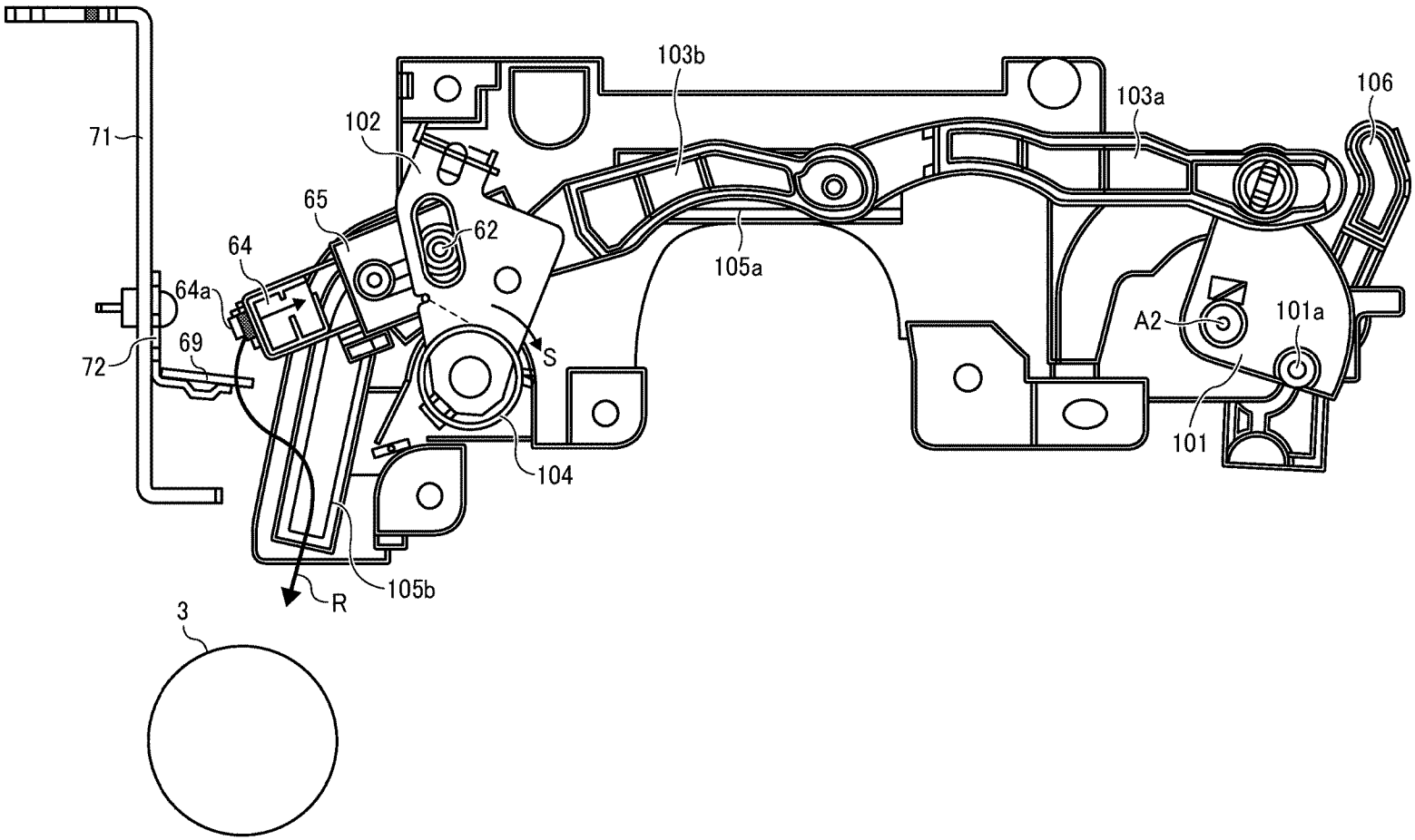
FIG. 35 is a diagram illustrating a configuration in which a cleaning member that cleans the lens surface of the exposure device is disposed on a retraction path of the exposure device.
Figure 36:
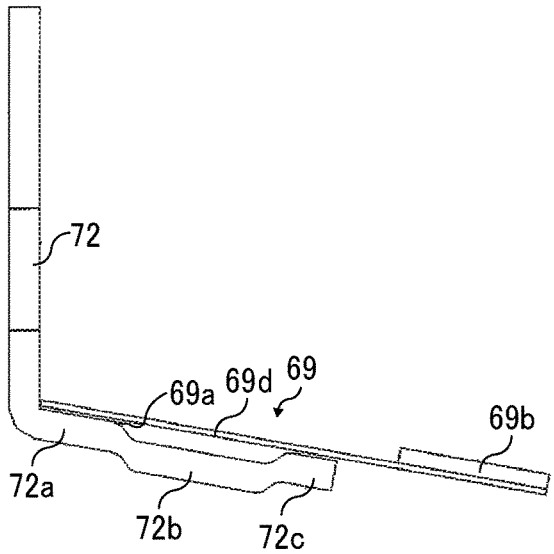
FIG. 36 is a side view illustrating the cleaning member and the holding member.

FIG. 35 is a diagram illustrating a configuration in which the cleaning member 69 that cleans the lens surface 64*a* of the exposure device 60 is disposed in the middle of the retraction path R of the exposure device 60. FIG. 36 is a side view illustrating the cleaning member 69 and the holding member 72.

As described above, by opening and closing the cover 91, the exposure device 60 moves from the exposure position to the retracted position along the retracted path R of a straight line trajectory and a curved trajectory. As illustrated in FIG. 35, by disposing the cleaning member 69 having elasticity on the curved trajectory of the retraction path R, when the exposure de vice 60 moves from the retracted position to the exposure position, the lens surface 64*a* of the exposure device 60 is pressed against the cleaning member 69. According to this configuration, foreign materials such as toner and dust are transferred from the lens surface 64*a* to the cleaning member 69, and therefore the foreign materials on the lens surface 64*a* can be removed.

The cleaning member 69 is a flexibly bendable member, for example, a member including a non-woven cloth 69*b* attached to a thin mylar 69*d* (see FIG. 36) or a member including a brush. Alternatively, a member including a sponge seal member can be replaced with the above-described members. As illustrated in FIGS. 35 and 36, the cleaning member 69 in Embodiment 5 includes the non-woven cloth 69*b* attached to the mylar 69*d*, which is fixed to the holding member 72 with a double sided tape 69*a*. The holding member 72 is an L-shaped member fixed to the apparatus body stay 71, for example, with screws.

Figure 37:
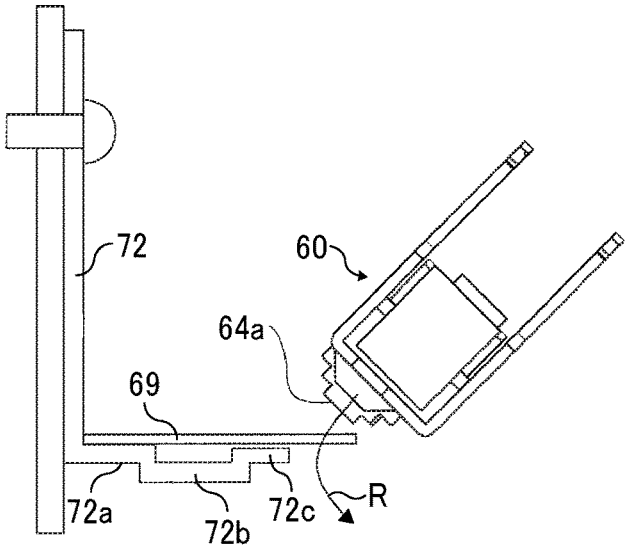
FIG. 37 is a diagram illustrating a state before the lens surface of the exposure device contacts the cleaning member when the exposure device moves from the retracted position to the exposure position.
Figure 38:
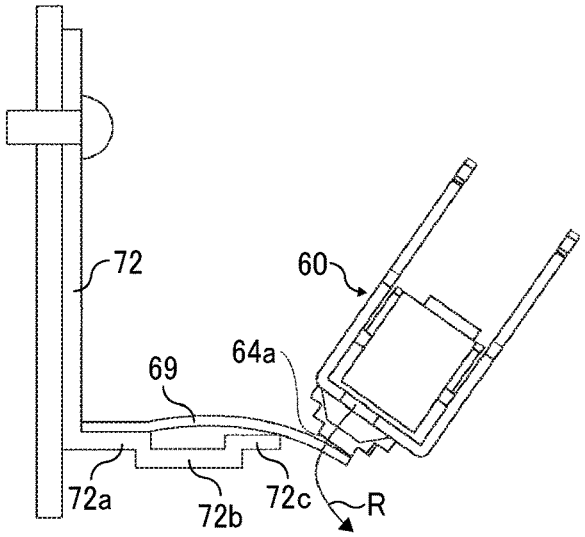
FIG. 38 is a diagram illustrating a state in which the lens surface of the exposure device is in contact with the cleaning member when the exposure device moves from the retracted position to the exposure position.
Figure 39:
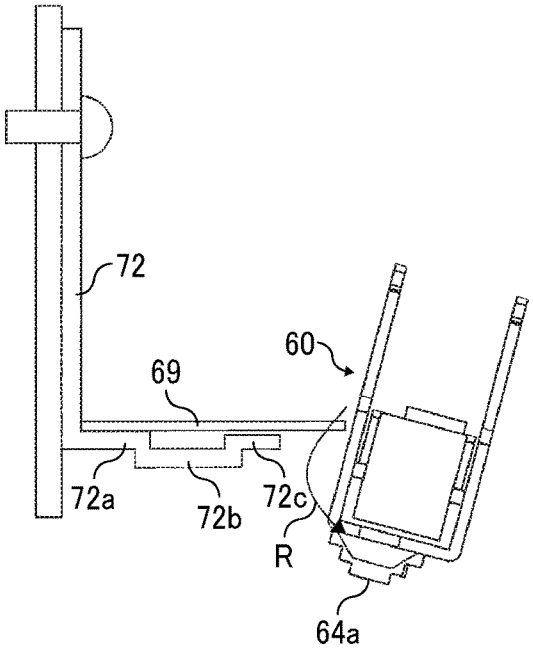
FIG. 39 is a diagram illustrating a state in which the lens surface of the exposure device is separated from the cleaning member when the exposure device moves from the retracted position to the exposure position.
Figure 40:
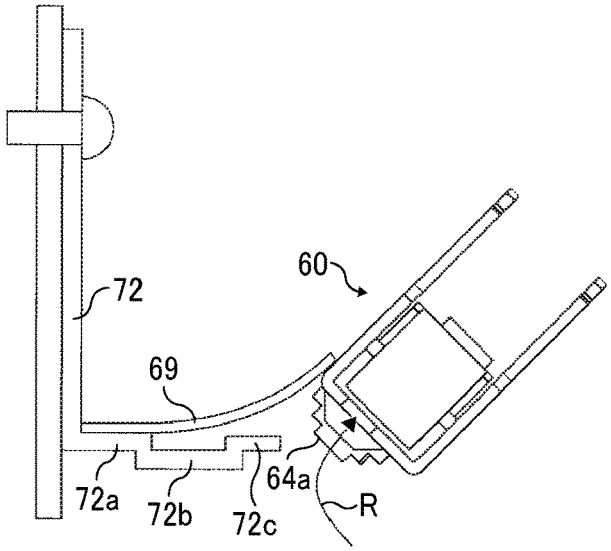
FIG. 40 is a diagram illustrating a state in which the exposure device is in contact with the cleaning member when the exposure device moves from the exposure position to the retracted position.

FIGS. 37, 38, 39, and 40 are diagrams illustrating changes of the position of the exposure device 60 and the state of the cleaning member 69 when the cleaning member 69 is disposed at a position along the curved trajectory of the exposure device 60. Specifically, FIG. 37 is a diagram illustrating a state before the lens surface 64*a* of the exposure device 60 contacts the cleaning member 69 when the exposure device 60 moves from the retracted position to the exposure position. FIG. 38 is a diagram illustrating a state in which the lens surface 64*a* of the exposure device 60 is in contact with the cleaning member 69 when the exposure device 60 moves from the retracted position to the exposure position. FIG. 39 is a diagram illustrating a state in which the lens surface 64*a* of the exposure device 60 is separated from the cleaning member 69 when the exposure device 60 moves from the retracted position to the exposure position. FIG. 40 is a diagram illustrating a state in which the exposure device 60 is in contact with the cleaning member 69 when the exposure device 60 moves from the exposure position to the retracted position.

As illustrated in FIGS. 37 and 38, the holding member 72 includes an attaching portion 72*a*, a separating portion 72*b*, and a regulating portion 72*c*. The attaching portion 72*a* is a portion to which the cleaning member 69 is attached. The separating portion 72*b* has a recess separated from the cleaning member 69. The regulating portion 72*c* regulates deformation or bending of the cleaning member 69 having elasticity. By disposing the cleaning member 69 on the retraction path R of the exposure device 60, the lens surface 64*a* contacts the cleaning member 69 when the exposure device 60 moves, so that the cleaning member 69 cleans the lens surface 64*a*. When the lens surface 64*a* contacts, the cleaning member 69 bends along the lens surface 64*a* based on the attaching portion 72*a* due to the elasticity. Further, as the bent or deformed cleaning member 69 contacts the regulating portion 72*c*, the cleaning member 69 bends along the lens surface 64*a* based on the regulating portion 72*c*. A distance between the lens surface 64*a* and the regulating portion 72*c* is shorter than a distance between the lens surface 64*a* and the attaching portion 72*a*. In other words, the attaching portion 72*a* is located farther than the regulating portion 72*c* from the lens surface 64*a*. Therefore, a greater stress is applied from the cleaning member 69 to the lens surface 64*a*, and therefore a stress sufficient to clean the lens surface 64*a* can be obtained.

Thereafter, as the exposure device 60 further moves, the cleaning member 69 returns to an original attitude, as illustrated in FIG. 39. Since the cleaning member 69 cannot be bent or deformed constantly by the exposure device 60, the cleaning member 69 can be prevented from being bent or deformed permanently.

By contrast, when the exposure device 60 moves along the retraction path 1*t* from the exposure position to the retracted position, the cleaning member 69 employed in the configuration of Embodiment 5 contacts the side face of the exposure device 60 but does not contact the regulating portion 72*c*, as illustrated in FIG. 40. The cleaning member 69 can easily bend or deformed based on the attaching portion 72*a*, and eventually returns to the original shape, as illustrated in FIG. 37. Consequently, when the exposure device 60 moves in the vicinity of the cleaning member 69, the cleaning member 69 applies a degree of load to the movement of the exposure device 60, and therefore a degree of load applied when the exposure device 60 moves to one side and another degree of load applied when the exposure device 60 moves an opposite side are different. The degree of load applied to the exposure device 60 when the exposure device 60 moves from the exposure position to the retracted position is smaller than the degree of load applied to the exposure device 60 when the exposure device 60 moves from the retracted position to the exposure position.

In Embodiment 5, as described above, when the exposure device 60 passes a cleaning position at which the cleaning member 69 cleans the lens surface 64*a* in the process of movement of the exposure device 60 from the retracted position to the exposure position, a relatively large degree of load is applied to the movement of the exposure device 60. By contrast, when the exposure device 60 passes the cleaning position in the process of movement of the exposure device 60 from the exposure position to the retracted position, a relatively small degree of load is applied to the movement of the exposure device 60. Therefore, the retraction unit 100 is preferably configured to switch the biasing force of the torsion spring 104 between the cleaning position and the exposure position.

In a case in which the retraction unit 100 is switchable in the biasing force of the torsion spring 104 between the retracted position and the cleaning position, in the process of movement of the exposure device 60 from the retracted position to the exposure position, a user causes the exposure device 60 to move manually or by a manual force of a user or an operator via the cover 91 and the cleaning lever 106. Accordingly, the biasing force of the torsion spring 104 switches the direction to the retracted position to the direction to the exposure position before the cleaning position. As the direction of the biasing force of the torsion spring 104 changes, the exposure device 60 moves by the biasing force of the torsion spring 104 instead of the manual force by the user. Therefore, in a case in which the retraction unit 100 is configured to switch the direction of the biasing force of the torsion spring 104 between the retracted position and the cleaning position, the exposure device 60 moves by the biasing force of the spring 104.

As described above, a relatively large degree of load is applied to the exposure device 60 when the exposure device 60 passes the cleaning position in the process of movement of the exposure device 60 from the retracted position to the exposure position. Therefore, when the biasing force of the torsion spring 104 is relatively small, the degree of load applied to the movement of the exposure device 60 when passing the cleaning position becomes greater than the biasing force of the torsion spring 104, and therefore the exposure device 60 stops at the cleaning position. As a result, the exposure device 60 is not likely to be moved to the retracted position. Accordingly, the torsion spring 104 includes a high spring constant so as not to cause the exposure device 60 to stop at the cleaning position.

By contrast, in a case in which the retraction unit 100 is configured to switch the direction of the biasing force of the torsion spring 104 between the cleaning position and the exposure position, in the process of movement of the exposure device 60 from the retracted position to the exposure position, the exposure device 60 is moved to the cleaning position manually or by a manual force of a user or an operator via the cover 91 and the cleaning lever 106. After completion of the movement of the exposure device 60 to the cleaning position, the direction of the biasing force of the torsion spring 104 is switched from the direction to the retracted position to the direction to the exposure position. Therefore, the exposure device 60 is moved to the cleaning position by the manual force of the user or the operator in the process of movement of the exposure device 60 from the retracted position to the exposure position. By contrast, in a case in which the retraction unit 100 is configured to switch the direction of the biasing force of the torsion spring 104 between the cleaning position and the exposure position, the direction of the biasing force of the torsion spring 104 switches from the direction to the exposure position to the direction to the retracted position before the exposure device 60 passes the cleaning position in the process of movement of the exposure device 60 from the exposure position to the retracted position. Therefore, the exposure device 60 is moved to the cleaning position by the biasing force of the torsion spring 104 in the process of movement of the exposure device 60 from the exposure position to the retracted position. However, the degree of load applied to the exposure device 60 when passing the cleaning position in the process of movement of the exposure device 60 from the exposure position to the retracted position is smaller than the degree of load applied to the exposure device 60 when passing the cleaning position in the process of movement of the exposure device from the retracted position to the exposure position. Therefore, when the exposure device 60 is moved from the retracted position to the exposure position, even though the biasing force of the torsion spring 104 is smaller than the configuration in which the exposure position 60 passes the cleaning position by the biasing force of the torsion spring 104, the exposure device 60 can be moved to the retracted position by the biasing force of the torsion spring 104 without stopping at the cleaning position due to the degree of load applied to the exposure device 60 when passing the cleaning position.

Accordingly, by providing the retraction unit 100 to switch the direction of the biasing force of the torsion spring 104 between the cleaning position and the exposure position, the torsion spring 104 has a lower spring constant than the torsion spring 104 used in the configuration in which the retraction unit 100 is configured to switch the direction of the biasing force of the torsion spring 104 between the retracted position and the cleaning position. Consequently, the retraction unit 100 can be designed to have a lower stiffness, and therefore the image forming apparatus 1 can be designed at lower cost.

Figure 41:
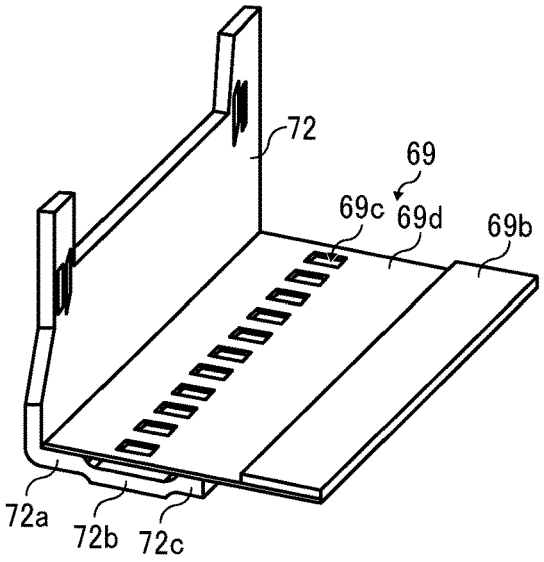
FIG. 41 is a perspective view illustrating the cleaning member having multiple openings and the holding member.
Figure 42:
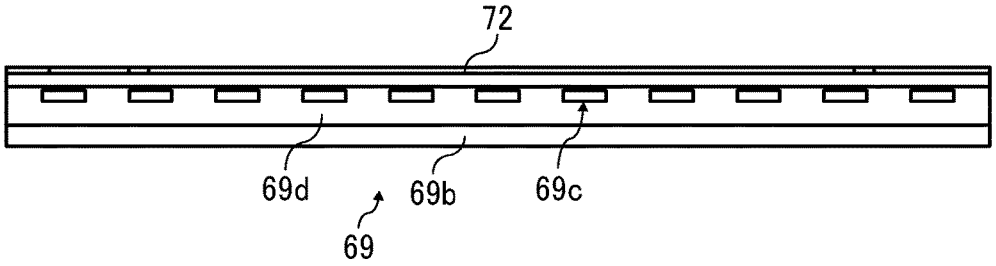
FIG. 42 is a top view illustrating the cleaning member having the multiple openings and the holding member.

FIG. 41 is a perspective view illustrating the cleaning member 69 having multiple openings 69*c* and the holding member 72. FIG. 42 is a top view illustrating the cleaning member 69 having the multiple openings 69*c* and the holding member 72.

As illustrated in FIGS. 41 and 42, the cleaning member 69 includes the multiple openings 69*c* in the separating portion 72*b* located between the attaching portion 72*a* and the regulating portion 72*c* of the holding member 72. According to this configuration, when the exposure device 60 moves from the exposure position to the retracted position (see FIG. 40), the cleaning member 69 can be bent or deformed with a smaller force. By contrast, when the exposure device 60 moves from the retracted position to the exposure position to clean the lens surface 64*a* (see FIG. 38), it is preferable that a total length of the openings 69*c* is set to be equal to or smaller than half (½) of the longitudinal length of the cleaning member 69 in order not to cause a stress applied to the exposure device 60 to be too small.

Figure 43:
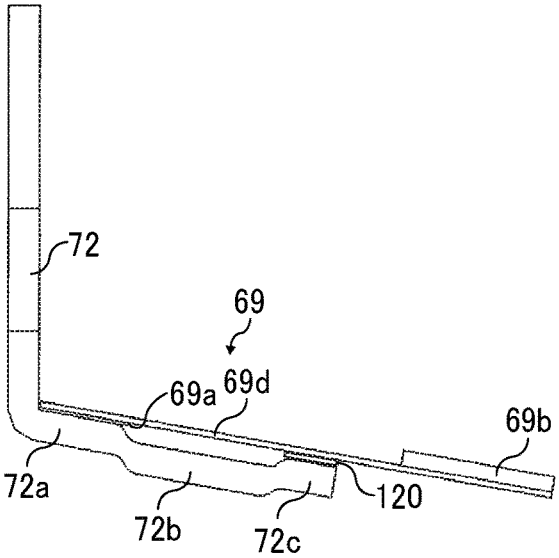
FIG. 43 is a diagram illustrating a configuration in which a foam member is disposed between the cleaning member and the holding member.

FIG. 43 is a diagram illustrating a configuration in which a foam member 120 is disposed between the cleaning member 69 and the regulating portion 72*c* of the holding member 72.

As illustrated in FIG. 40, when the exposure device 60 moves to the retracted position, the cleaning member 69 is flipped by the exposure device 60 and moves to the original attitude. At that time, the exposure device 60 contacts the regulating portion 72*c* of the holding member 72, generating a sound of impact. Accordingly, as illustrated in FIG. 43, the foam member 120 is disposed between the cleaning member 69 and the regulating portion 72*c* of the holding member 72. Consequently, a sound of impact generated by the cleaning member 69 contacting the holding member 72 when the cleaning member 69 returns to the original attitude can be reduced.

The configurations according to the above-descried embodiments are not limited thereto. This disclosure can achieve the following aspects effectively.

Aspect A.

In Aspect A, an image forming apparatus (for example, the image forming apparatus 1) includes an image bearer (for example, the photoconductor drum 3), an exposure device (for example, the exposure device 60), a drive device (for example, the retracting unit 100), a cleaning body (for example, the cleaning member 69), and an exposure device holder (for example, the holder 65). The exposure device is disposed on a motion trajectory (for example, the retraction path R) between an exposure position close to the image bearer and a retracted position separated from the image bearer. The exposure device is configured to emit light to the image bearer via a lens having a lens surface (for example, the lens surface 64*a*) at the exposure position at which the image bearer is irradiated. The drive device is configured to cause the exposure device to move between the exposure position and the retracted position. The cleaning body has a flexible shape and is disposed on the motion trajectory of the exposure device. The cleaning body is configured to tilt a cleaning surface when contacting with the lens surface of the exposure device. The exposure device holder is configured to support the exposure device while changing an attitude of the exposure device such that the lens surface of the exposure device remains in contact with the cleaning surface of the cleaning body that inclines by a contact pressure applied by the lens surface of the exposure device when the exposure device moves from the retracted position to the exposure position.

According to this configuration, as described in Embodiment 1, the attitude of the exposure device 60 changes when the exposure device 60 moves from the retracted position to the exposure position. Due to the change of attitude of the exposure device, the cleaning face of the cleaning body that changes the shape by the pressing force to the lens surface of the exposure device remains in contact with the lens surface of the exposure device. Therefore, the cleaning performance of the cleaning body to the lens surface of the exposure device can be enhanced.

Aspect B.

In Aspect A, the exposure device holder (for example, the holder 65) holds the exposure device (for example, the exposure device 60) such that the exposure device rotates while the cleaning surface of the cleaning body (for example, the cleaning member 69) is in contact with the lens surface (for example, the lens surface 64*a*) of the exposure device.

According to this configuration, as described in Embodiment 1, as the exposure device rotates, the lens surface contacts the cleaning body while the lens surface is rotating. Therefore, the cleaning body can remove foreign material from the entire area of the lens surface.

Aspect C.

In Aspect A or Aspect B, the cleaning body (for example, the cleaning member 69) is elastic.

According to this configuration, as described in Embodiment 1, when the lens surface contacts the cleaning body, the cleaning body flexibly bends to contact the entire area of the lens surface.

Aspect D.

In Aspect C, the cleaning body (for example, the cleaning member 69) includes an elastic base material (for example, the mylar 69*d*) and a fabric material (for example, the non-woven cloth 69*d*).

According to this configuration, as described in Embodiment 1, the base material deforms so that the fabric material contacts the entire area of the lens surface.

Aspect E.

In any one of Aspect A through Aspect D, the image forming apparatus (for example, the image forming apparatus 1) further includes an electrical discharging body (for example, the electrical discharging members 200 and 211) configured to remove electric charge on the exposure device (for example, the exposure device 60) and to contact the lens surface (for example, the lens surface 64*a*) of the exposure device on the motion trajectory of the exposure device between the exposure position and the retracted position.

According to this configuration, as described in Embodiment 2, the electric charge of the lens surface transferred when the lens surface of the exposure device contacts the cleaning body is neutralized by the electrical discharging member. Therefore, the charged state of the cleaning body can is relaxed. Accordingly, the exposing operation is performed without attracting any floating material to the lens surface, and therefore high-quality images can be obtained permanently.

Aspect F.

In Aspect E, at least one of the cleaning body (for example, the cleaning member 69) and the electrical discharging body (for example, the electrical discharging members 200 and 211) includes a brush (for example, the brush 212).

According to this configuration, as described in Embodiment 1, when compared with a flat cleaning body and a flat electrical discharging body, the cleaning body and the electrical discharging body can contact the entire area of the lens surface (for example, the lens surface 64*a*) more easily. Therefore, the cleaning body can be more enhanced in the cleaning performance and the electrical discharging performance.

Aspect G.

In Aspect F, the brush (for example, the brush 212) includes multiple brush fibers (212*a*) and a fiber fixing face (212*b*). The multiple brush fibers of the brush of the at least one of the cleaning body (for example, the cleaning member 69) and the electrical discharging body (for example, the electrical discharging members 200 and 211) are fixed to the fiber fixing face at a predetermined angle.

According to this configuration, as described in Embodiment 3 with reference to FIGS. 22 through 25, when compared with a configuration in which the multiple brush fibers are fixed to the fiber fixing face in a direction perpendicular to the fiber fixing face, the length of the multiple brush fibers can extend longer in length. Accordingly, when compared with the configuration in which the multiple brush fibers are fixed in a direction perpendicular to the fiber fixing face, a touch of the brush to the lens surface (for example, the lens surface 64*a*) can be softer and the operation force applied to the movement of opening and closing of the cover (for example, the cover 91) can be reduced.

Aspect H.

In any one of Aspect E through Aspect G, at least one of the cleaning body (for example, the cleaning member 69) and the electrical discharging body (for example, the electrical discharging members 200 and 211) includes a conductive material.

According to this configuration, as described in Embodiment 3, the electric charges generated by friction of the lens surface (for example, the lens surface 64*a*) and the cleaning body or the electrical discharging body are distributed. Therefore, the charged state of the cleaning body is relaxed and the good cleaning performance can be maintained. Further, the charged state of the electrical discharging member is also relaxed, and therefore the good electrical discharging performance can be maintained.

Aspect I.

In Aspect H, the image forming apparatus (for example, the image forming apparatus 1) further includes an apparatus body (for example, the apparatus body 30). The at least one of the cleaning body (for example, the cleaning member 69) and the electrical discharging body (for example, the electrical discharging members 200 and 211) is electrically grounded to the apparatus body.

According to this configuration, as described in Embodiment 3, the electric charges generated by friction of the lens surface (for example, the lens surface 64*a*) and the cleaning body or the electrical discharging body are distributed more reliably.

Aspect J.

In any one of Aspect A through Aspect I, the image forming apparatus (for example, the image forming apparatus 1) further includes a rotary body holder (for example, the cleaning member holding portions 220*a*) and a rotation regulator (for example, the rotation regulating member 221). The rotary body holder is configured to rotatably hold the cleaning body (for example, the cleaning member 222) toward a first rotation direction in which the exposure device (for example, the exposure device 60) is directed to the exposure position and toward a second rotation direction in which the exposure device is directed to the retracted position. The rotation regulator is configured to regulate movement of the cleaning body such that the cleaning body is stopped rotating in the first rotation direction while the cleaning surface of the cleaning body is in contact with the lens surface of the exposure device when the exposure device is moving from the retracted position to the exposure position and that the cleaning body is continuously rotated when the exposure device is moving from the exposure position to the retracted position.

According to this configuration, as described in Embodiment 4, the movement (rotation) of the cleaning body is regulated when the exposure device moves in the first rotation direction, and therefore the cleaning body can clean the lens surface (for example, the lens surface 64*a*) sufficiently. Further, the movement (rotation) of the cleaning body is not regulated when the exposure device moves in the second rotation direction, and therefore a degree of load on the movement of the exposure device can be reduced.

Aspect K.

In any one of Aspect A through Aspect J, the image forming apparatus (for example, the image forming apparatus 1) further includes a sheet body (for example, the mylar 69*d*) and a holding body (for example, the holding member 72). The sheet body includes an elastic material and configured to support the cleaning body (for example, the cleaning member 69). The holding body is configured to hold the sheet body. The sheet body presses the cleaning body by elasticity of the elastic material of the sheet body. A pressure force applied by the cleaning body to press the lens of the exposure device (for example, the exposure device 60) when the exposure device moves to the exposure position is different from a pressure force applied by the cleaning body to press the lens of the exposure device when the exposure device moves to the retraction position.

According to this configuration, as described in Embodiment 5, the pressing force of the cleaning body applied when the exposure device moves to the retracted position is smaller than the pressing force of the cleaning body applied when the exposure device moves to the exposure position. Accordingly, the degree of load on the exposure device when the exposure device moves from the exposure position to the retracted position is smaller than the degree of load on the exposure device when the exposure device moves from the retracted position to the exposure position.

Aspect L.

In any one of Aspect A through Aspect K, the image forming apparatus (for example, the image forming apparatus 1) further includes a cover (for example, the cover 91) configured to move together with movement of the exposure device holder (for example, the holder 65). The exposure device holder holds the exposure device (for example, the exposure device 60) such that the exposure device moves to the retracted position together with an opening motion of the cover and that the exposure device moves to the exposure position together with a closing motion of the cover.

According to this configuration, as described in Embodiment 1, by opening and closing the cover, the lens surface (for example, the lens surface 64*a*) is automatically cleaned by the cleaning body (for example, the cleaning member 69), and therefore the high quality image formation can be achieved.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. An image forming apparatus comprising:

an image bearer;

an exposure device disposed on a motion trajectory between an exposure position close to the image bearer and a retracted position separated from the image bearer, the exposure device configured to emit light to the image bearer via a lens having a lens surface at the exposure position at which the image bearer is irradiated;

a drive device configured to cause the exposure device to move between the exposure position and the retracted position;

a cleaning body having a flexible shape and disposed on the motion trajectory of the exposure device, the cleaning body configured to tilt a cleaning surface when contacting with the lens surface of the exposure device; and an exposure device holder configured to support the exposure device while changing an attitude of the exposure device such that the lens surface of the exposure device remains in contact with the cleaning surface of the cleaning body that inclines by a contact pressure applied by the lens surface of the exposure device when the exposure device moves from the retracted position to the exposure position, the exposure device holder being further configured to hold the exposure device, such that the exposure device is rotatable while the cleaning surface of the cleaning body is in contact with the lens surface of the exposure device.

2. The image forming apparatus according to claim 1, wherein the cleaning body is elastic.

3. The image forming apparatus according to claim 2, wherein the cleaning body includes an elastic base material and a fabric material.

4. The image forming apparatus according to claim 1, further comprising:

a rotary body holder configured to rotatably hold the cleaning body toward a first rotation direction in which the exposure device is directed to the exposure position and toward a second rotation direction in which the exposure device is directed to the retracted position; and a rotation regulator configured to regulate movement of the cleaning body such that the cleaning body is to be stopped rotating in the first rotation direction while the cleaning surface of the cleaning body is in contact with the lens surface of the exposure device when the exposure device is moving from the retracted position to the exposure position and such that the cleaning body is to be continuously rotated when the exposure device is moving from the exposure position to the retracted position.

5. The image forming apparatus according to claim 1, further comprising:

a sheet body including an elastic material and configured to support the cleaning body; and a holding body configured to hold the sheet body, wherein the sheet body presses the cleaning body by elasticity of the elastic material of the sheet body, and wherein a pressure force, to be applied by the cleaning body to press the lens of the exposure device when the exposure device moves to the exposure position, is different from a pressure force to be applied by the cleaning body to press the lens of the exposure device when the exposure device moves to the retraction position.

6. The image forming apparatus according to claim 1, further comprising a cover, configured to move together with movement of the exposure device holder, wherein the exposure device holder is configured to hold the exposure device such that the exposure device moves to the retracted position together with an opening motion of the cover and is configured to hold the exposure device such that the exposure device moves to the exposure position together with a closing motion of the cover.

7. The image forming apparatus according to claim 1, further including an electrical discharging body configured to remove electric charge on the exposure device and configured to contact the lens surface of the exposure device on the motion trajectory of the exposure device between the exposure position and the retracted position.

8. The image forming apparatus according to claim 7, wherein at least one of the cleaning body and the electrical discharging body includes a brush.

9. The image forming apparatus according to claim 8, wherein the brush includes multiple brush fibers and a fiber fixing face, and wherein the multiple brush fibers of the brush of the at least one of the cleaning body and the electrical discharging body are fixed to the fiber fixing face at an angle.

10. The image forming apparatus according to claim 7, wherein at least one of the cleaning body and the electrical discharging body includes a conductive material.

11. The image forming apparatus according to claim 10, further comprising an apparatus body, wherein the at least one of the cleaning body and the electrical discharging body is electrically grounded to the apparatus body.

12. An image forming apparatus comprising:

an image bearer;

an exposure device disposed on a motion trajectory between an exposure position close to the image bearer and a retracted position separated from the image bearer, the exposure device configured to emit light to the image bearer via a lens having a lens surface at the exposure position at which the image bearer is irradiated;

a drive device configured to cause the exposure device to move between the exposure position and the retracted position;

a cleaning body having a flexible shape and disposed on the motion trajectory of the exposure device, the cleaning body configured to tilt a cleaning surface when contacting with the lens surface of the exposure device; and an exposure device holder configured to support the exposure device while changing an attitude of the exposure device such that the lens surface of the exposure device remains in contact with the cleaning surface of the cleaning body that inclines by a contact pressure applied by the lens surface of the exposure device when the exposure device moves from the retracted position to the exposure position; and an electrical discharging body configured to remove electric charge on the exposure device and configured to contact the lens surface of the exposure device on the motion trajectory of the exposure device between the exposure position and the retracted position.

13. The image forming apparatus according to claim 12, wherein at least one of the cleaning body and the electrical discharging body includes a brush.

14. The image forming apparatus according to claim 13, wherein the brush includes multiple brush fibers and a fiber fixing face, and wherein the multiple brush fibers of the brush of the at least one of the cleaning body and the electrical discharging body are fixed to the fiber fixing face at an angle.

15. The image forming apparatus according to claim 12, wherein at least one of the cleaning body and the electrical discharging body includes a conductive material.

16. The image forming apparatus according to claim 15, further comprising an apparatus body, wherein the at least one of the cleaning body and the electrical discharging body is electrically grounded to the apparatus body.

17. The image forming apparatus according to claim 15, wherein at least one of the cleaning body and the electrical discharging body includes a brush.

18. The image forming apparatus according to claim 17, wherein the brush includes multiple brush fibers and a fiber fixing face, and wherein the multiple brush fibers of the brush of the at least one of the cleaning body and the electrical discharging body are fixed to the fiber fixing face at an angle.

19. The image forming apparatus according to claim 12, wherein the cleaning body is elastic.

20. The image forming apparatus according to claim 19, wherein the cleaning body includes an elastic base material and a fabric material.

* * * * *